US009952524B2

(12) United States Patent
Kinoshita et al.

(10) Patent No.: US 9,952,524 B2
(45) Date of Patent: Apr. 24, 2018

(54) MAGNETIC CARRIER FOR ELECTROPHOTOGRAPHIC DEVELOPER AND PROCESS FOR PRODUCING THE SAME, AND TWO-COMPONENT SYSTEM DEVELOPER

(71) Applicant: TODA KOGYO CORP., Hiroshima-shi, Hiroshima-ken (JP)

(72) Inventors: Kaori Kinoshita, Otake (JP); Eiichi Kurita, Otake (JP)

(73) Assignee: TODA KOGYO CORP., Hiroshima (JP)

( * ) Notice: Subject to any disclaimer, the term of this patent is extended or adjusted under 35 U.S.C. 154(b) by 0 days.

(21) Appl. No.: 14/404,543

(22) PCT Filed: May 30, 2013

(86) PCT No.: PCT/JP2013/065013

§ 371 (c)(1),
(2) Date: Nov. 28, 2014

(87) PCT Pub. No.: WO2013/180212

PCT Pub. Date: Dec. 5, 2013

(65) Prior Publication Data

US 2015/0192874 A1 Jul. 9, 2015

(30) Foreign Application Priority Data

May 31, 2012 (JP) ..... 2012-125449

(51) Int. Cl.

| | |
|---|---|
| ***G03G 9/113*** | (2006.01) |
| ***G03G 9/107*** | (2006.01) |
| ***G03G 9/10*** | (2006.01) |

(52) U.S. Cl.

CPC ..... *G03G 9/1135* (2013.01); *G03G 9/10* (2013.01); *G03G 9/107* (2013.01); *G03G 9/1075* (2013.01); *G03G 9/1131* (2013.01); *G03G 9/1133* (2013.01); *G03G 9/1136* (2013.01)

(58) Field of Classification Search

CPC .... G03G 9/107; G03G 9/1135; G03G 9/1137; G03G 9/1131; G03G 9/1075

See application file for complete search history.

(56) References Cited

U.S. PATENT DOCUMENTS

| | | | |
|---|---|---|---|
| 2002/0172884 | A1 | 11/2002 | Kayamoto et al. |
| 2003/0091922 | A1 | 5/2003 | Okado et al. |
| 2007/0231732 | A1 | 10/2007 | Shinmura et al. |
| 2012/0115078 | A1 | 5/2012 | Kinoshita et al. |

FOREIGN PATENT DOCUMENTS

| | | | |
|---|---|---|---|
| EP | 1 237 051 | | 9/2002 |
| JP | 2-220068 | | 9/1990 |
| JP | 3-192268 | | 8/1991 |
| JP | 8-6303 | | 1/1996 |
| JP | 9-311505 | | 12/1997 |
| JP | 2000-39742 | | 2/2000 |
| JP | 2000-199985 | | 7/2000 |
| JP | 2002-091090 | A * | 3/2002 |
| JP | 2002-296846 | | 10/2002 |
| JP | 2002-328493 | | 11/2002 |
| JP | 2003-43756 | | 2/2003 |
| JP | 2004/252211 | | 9/2004 |
| JP | 2004/286879 | | 10/2004 |
| JP | 2005-99072 | | 4/2005 |
| JP | 2007-206481 | | 8/2007 |
| JP | 2007-271662 | | 10/2007 |
| JP | 2010/014853 | | 1/2010 |
| JP | 2011-2497 | | 1/2011 |

OTHER PUBLICATIONS

English language machine translation of JP 2002-91090 (Mar. 2002).*

English language machine translation of JP 2011-002497 (Jan. 2011).*

Extended European Search Resort issued in App. No. 13796970.5 dated Dec. 9, 2015.

International Search Report for PCT/JP2013/065013, dated Jun. 25, 2013.

International Preliminary Report on Patentability issued in International Patent Application No. PCT/JP2013/065013 dated Dec. 11, 2014.

* cited by examiner

*Primary Examiner* — Christopher D Rodee

(74) *Attorney, Agent, or Firm* — Nixon & Vanderhye P.C.

(57) ABSTRACT

The present invention relates to a magnetic carrier for an electrophotographic developer comprising spherical composite core particles comprising at least ferromagnetic iron oxide fine particles and a cured phenol resin, and having an average particle diameter of 20 to 60 μm, the magnetic carrier for an electrophotographic developer satisfying the formula (1): $\sigma_1-\sigma_0=-2$ to 0 wherein $\sigma_0$ represents a saturation magnetization ($Am^2/kg$) of the carrier particles having a particle diameter in the vicinity of the average particle diameter of the magnetic carrier for an electrophotographic developer; and $\sigma_1$ represents a saturation magnetization ($Am^2/kg$) of the carrier particles having a particle diameter of less than 20 μm, and a two-component system developer using the magnetic carrier. The two-component system developer of the present invention includes a magnetic carrier used for an electrophotographic developer which can exhibit a good durability, is free from occurrence of carrier adhesion, and can maintain a high quality of images produced for a long period of time, and comprises the magnetic carrier for an electrophotographic developer and a toner.

8 Claims, No Drawings

MAGNETIC CARRIER FOR ELECTROPHOTOGRAPHIC DEVELOPER AND PROCESS FOR PRODUCING THE SAME, AND TWO-COMPONENT SYSTEM DEVELOPER

This application is the U.S. national phase of International Application No. PCT/JP2013/065013 filed 30 May 2013 which designated the U.S. and claims priority to JP Patent Application No. 2012-125449 filed 31 May 2012, the entire contents of each of which are hereby incorporated by reference.

TECHNICAL FIELD

The present invention relates to a magnetic carrier for an electrophotographic developer which can exhibit a good durability, is free from occurrence of carrier adhesion, and can maintain a high quality of images produced for a long period of time, and a process for producing the magnetic carrier, as well as a two-component system developer comprising the magnetic carrier for an electrophotographic developer and a toner.

BACKGROUND ART

As is well known in the art, in electrophotographic methods, there has been generally adopted the method in which a photoreceptor formed of a photoconductive material such as selenium, OPC (organic semiconductor), a-Si or the like is used to form an electrostatic latent image thereon by various means. Then, by using a magnetic brush development method or the like, a toner that is charged into a polarity reverse to that of the latent image is attached onto the latent image by an electrostatic force to develop the latent image.

In the above developing process, there is used a two-component system developer comprising a toner and a carrier. The carrying particles called a magnetic carrier act for imparting an appropriate positive or negative electrical quantity to the toner by frictional electrification, and also act for transferring the toner through a developing sleeve accommodating magnets therein into a developing zone near the surface of the photoreceptor on which the latent image is formed, by using a magnetic force of the magnets.

The electrophotographic methods have been widely applied to copying machines and printers. In recent years, in the market, there is an increasing demand for electrophotographic images having a much higher stability and quality. In order to meet the requirement for high-quality images, it is considered to be effective to reduce a particle size of the carrier. For this reason, various small-size carriers have been proposed. The small-size carriers are capable of forming a dense magnetic brush with bristles having a good flowability, and therefore hardly suffer from occurrence of traces of the bristles on images produced, etc. However, with the reduction in particle size of the carrier, individual carrier particles have a reduced magnetization, so that a constraint force of the magnetic carrier on a developing sleeve tends to become small. As a result, a so-called carrier adhesion phenomenon in which the carrier is transferred from a developer carrying member to a photoreceptor to thereby produce defective images tends to be readily caused.

Further, since the small-size carrier is unlikely to cause frictional electrification with a toner because of a poor flowability thereof, there has been proposed the method in which a toner and a carrier are stirred and mixed with each other with an enhanced agitation intensity. However, the enhanced agitation intensity tends to cause increase in stress exerted on the developer, so that there tends to occur a so-called spent toner phenomenon in which the toner is adhered onto a surface of the carrier. As a result, there tends to arise such a problem that deterioration in properties of the developer is promoted, and it is not possible to maintain good properties of the developer for a long period of time.

With the market's requirements such as personalization and space saving, reduction in size of the electrophotographic image-forming apparatuses such as copying machines and printers has been promoted. Further, with the reduction in size of these apparatuses, reduction in size of respective units used in the apparatuses have also been promoted, so that it is required to stably maintain properties of the developer even when used in such a small-size developing device, i.e., even when using the developer in a small amount.

In general, in order to reduce power consumption in small size apparatuses, there is a demand for a toner that is capable of sufficiently fixing images with a low fixing energy, i.e., a so-called low-temperature fixing toner. In the case of the toners that can ensure a good fixing property at a low temperature by using a low-molecular weight resin therein, etc., it is possible to achieve saving of energy. However, when subjected to repeated development a plurality of times for a long period of time, the toners tend to be spent on a surface of the carrier during continuous use under high-temperature and high-humidity conditions owing to heat or pressure generated thereupon, or the carrier particles tend to be strongly coagulated together such that the toner is entangled between the spent portions, so that there tends to arise such a phenomenon that the developer suffers from blocking, etc. As a result, variation in frictional electric charge amount of the developer tends to occur, thereby causing variation in image density and occurrence of fogging.

In order to prevent occurrence of spent toner onto the surface of the carrier, there has been conventionally proposed the method in which the surface of the carrier is coated with various resins. For example, it is known that the surface of the respective carrier core particles is coated with a releasable resin such as a fluororesin and a silicone resin. Such a coated carrier hardly suffers from occurrence of spent toner upon the development because the surface thereof is coated with the low-surface energy material. As a result, the carrier has a stable electric charge amount, and the developer using the carrier exhibits a long service life.

On the other hand, since the resin-coated carrier is in the form of an insulating material, the carrier hardly acts as a developing electrode, thereby causing such a phenomenon as referred to as an edge effect, in particular, at solid image portions. In addition, the developing bias tends to become large, so that there tends to occur carrier adhesion on non-image portions.

In order to solve the above problems, there has been proposed the method of adjusting an electric resistance value of a coating layer by dispersing a conductive material in the coating layer. However, even though an initial electric resistance value of the coating layer of the carrier is adjusted by the above method, the coating layer tends to be abraded and reduced by friction, falling-off, etc., owing to stirring in the developing device when used for a long period of time, so that if the core material is a conductive material having a low dielectric breakdown voltage, there occurs a leakage phenomenon owing to exposure of the core material to outside, thereby causing such a problem that the electric resistance value of the carrier is gradually decreased and the carrier is deposited on image-forming regions.

In general, in the case where carbon black or the like as the above conductive material is dispersed in the coating layer, the increase in amount of carbon black added tends to cause decrease in electric resistance value of the carrier. However, it may be difficult to prepare a carrier whose electric resistance value lies in a medium range of $10^8$ to $10^{12}$ Ωcm by varying the amount of carbon black added to the coating layer.

Also, the magnetic carrier of a resin-coated type exhibits a high electric resistance value when a voltage applied thereto is low. However, when applying a high voltage to the magnetic carrier, there tends to occur leakage of electric charges therefrom owing to adverse influence of a core material thereof by itself. In particular, when a low-electrical resistance material such as an iron powder and magnetite is used as the core material, the above tendency tends to become more remarkable. Thus, when the electric resistance value of the carrier has a large voltage dependency, the resulting images tend to be generally deteriorated in gradation.

Hitherto, as the carrier constituting a two-component system developer, there are known an iron powder carrier, a ferrite carrier and a magnetic material-dispersed carrier prepared by dispersing magnetic particles in a binder resin.

The iron powder carrier and ferrite carrier are usually used in the form of resin-coated particles. However, since the iron powder carrier has a true specific gravity as large as 7 to 8 g/cm$^3$, whereas the ferrite carrier has a true specific gravity as large as 4.5 to 5.5 g/cm$^3$. Therefore, a large driving force is required to stir these carriers in a developing device, resulting in significant mechanical damage to the device, occurrence of spent toner as well as deterioration in charging property of the carrier itself, and facilitated damage to a photoreceptor. Further, since the adhesion between the surface of the respective particles and the coating resin is not so good, the coating resin tends to be gradually peeled off during use with time, thereby causing variation in a charging property of the carrier. As a result, the problems such as formation of image defect and carrier adhesion tend to be caused.

The carriers of a magnetic material-dispersed type comprising spherical composite particles constituted of magnetic particles and a phenol resin as described in Japanese Patent Application Laid-Open (KOKAI) No. 2-220068 and Japanese Patent Application Laid-Open (KOKAI) No. 8-6303 have a true specific gravity of 3 to 4 g/cm$^3$ which is smaller than those of the above iron powder carrier and ferrite carrier, so that an energy upon impingement between the toner and carrier tends to be reduced, thereby advantageously avoiding occurrence of spent toner. Further, these carriers are far excellent in adhesion to coating resins as compared to the iron powder carrier or ferrite carrier and, therefore, hardly suffers from the problem that the coating resin is peeled-off therefrom during use.

However, with the recent wide spread of digital copying machines and laser beam printers using a reversal development method, it has been required that the carrier has not only a high dielectric breakdown voltage owing to application of a high bias voltage thereto in the method, but also provides a developed image having a high image density and a high quality with a good gradation, etc. Therefore, the carrier is required to have a long service life capable of maintaining various properties such as charging characteristics and electric resistance for a long period of time as compared to the conventional carriers.

Further, there have been attempted several methods in which composite particles comprising ferromagnetic iron oxide fine particles and a cured phenol resin are used as a magnetic carrier for an electrophotographic developer. For example, there are known the technology of coating a surface of respective composite core particles comprising ferromagnetic fine particles and a cured phenol resin with a melamine resin to increase an electric resistance value thereof (Patent Literature 1); the technology of forming a coating layer comprising a cured copolymer resin obtained from at least one resin selected from the group consisting of a melamine resin, an aniline resin and a urea resin, and a phenol resin, on a surface of respective composite core particles comprising iron oxide particles and a cured phenol resin to control an electric resistance value of a carrier (Patent Literature 2); the magnetic carrier comprising carrier core particles comprising ferromagnetic compound particles, non-magnetic inorganic compound particles and a phenol resin, and a nitrogen compound-containing or -bonding layer formed on the surface of the respective carrier core particles (Patent Literature 3); the carrier comprising core material particles comprising magnetic particles and a binder resin, and a first resin coating layer comprising a nitrogen-containing resin and a second resin coating layer comprising conductive particles which layers are formed on the surface of the respective core material particles (Patent Literature 4); or the like.

As typical examples of recent technologies for suppressing carrier adhesion, there are known the technology of defining a volume average particle diameter, a particle size distribution, an mean porosity and a magnetization value of a core material of the carrier as well as a difference in magnetization of the core material from that of scattered materials (Patent Literature 5), the technology of defining various properties of magnetic carrier particles comprising at least a binder resin and magnetic metal oxide particles, such as a number average particle diameter, a resistivity when applying a voltage of 25 to 500 V thereto, a true specific gravity, a magnetization intensity and a content of Fe(II) based on a concentration of an eluted iron element on a surface thereof (Patent Literature 6), the technology of defining a magnetization intensity of each of a resin carrier A having a specific average particle diameter and a resin carrier B comprising a specific amount of particles having a particle size of not more than 20 μm as measured by a mesh method, as well as a difference in magnetization between the carrier A and the carrier B (Patent Literature 7), and the like.

CITATION LIST

Patent Literature

Patent Literature 1: Japanese Patent Application Laid-Open (KOKAI) No. 3-192268

Patent Literature 2: Japanese Patent Application Laid-Open (KOKAI) No. 9-311505

Patent Literature 3: Japanese Patent Application Laid-Open (KOKAI) No. 2000-39742

Patent Literature 4: Japanese Patent Application Laid-Open (KOKAI) No. 2007-206481

Patent Literature 5: Japanese Patent Application Laid-Open (KOKAI) No. 2002-296846

Patent Literature 6: Japanese Patent Application Laid-Open (KOKAI) No. 2005-99072

Patent Literature 7: Japanese Patent Application Laid-Open (KOKAI) No. 2002-91090

SUMMARY OF INVENTION

Technical Problem

The respective technologies described in the above Patent Literatures 1 to 4 have various problems such as failure of adequately keeping an electric charge amount and an electric resistance value of the carriers upon development.

The respective technologies described in the above Patent Literatures 5 to 6 have posed such a problem that they failed to suppress carrier adhesion to a sufficient extent in view of the recent requirements for high-quality images and high-speed copying or printing machines.

Under these circumstances, an object of the present invention is to provide a magnetic carrier for an electrophotographic developer which can exhibit a good durability, is free from occurrence of carrier adhesion, and can maintain a high quality of images produced for a long period of time, and a process for producing the magnetic carrier, as well as a two-component system developer comprising the magnetic carrier for an electrophotographic developer and a toner.

Solution to Problem

The above object or technical task of the present invention can be achieved by the following Inventions.

That is, according to the present invention, there is provided a magnetic carrier for an electrophotographic developer comprising spherical composite core particles comprising at least ferromagnetic iron oxide fine particles and a cured phenol resin and having an average particle diameter of 20 to 60 μm, the magnetic carrier for an electrophotographic developer satisfying the following formula (1):

$$\sigma_1-\sigma_0=-2 \text{ to } 0 \quad (1)$$

wherein $\sigma_0$ represents a saturation magnetization ($Am^2/kg$) of the carrier particles having a particle diameter in the vicinity of the average particle diameter of the magnetic carrier for an electrophotographic developer; and $\theta_1$ represents a saturation magnetization ($Am^2/kg$) of the carrier particles having a particle diameter of less than 20 μm (Invention 1).

In addition, according to the present invention, there is provided a magnetic carrier for an electrophotographic developer comprising spherical composite particles comprising spherical composite core particles having an average particle diameter of 20 to 60 μm, comprising at least ferromagnetic iron oxide fine particles and a cured phenol resin, and a melamine resin coating layer formed on a surface of the respective core particles, (i) the magnetic carrier for an electrophotographic developer having a resin index $C_1$ of 50 to 90%; and (ii) the magnetic carrier for an electrophotographic developer satisfying the following formula (1):

$$\sigma_1-\sigma_0=-2 \text{ to } 0 \quad (1)$$

wherein $\sigma_0$ represents a saturation magnetization ($Am^2/kg$) of the carrier particles having a particle diameter in the vicinity of the average particle diameter of the magnetic carrier for an electrophotographic developer; and $\theta_1$ represents a saturation magnetization ($Am^2/kg$) of the carrier particles having a particle diameter of less than 20 μm (Invention 2).

Also, according to the present invention, there is provided the magnetic carrier for an electrophotographic developer as recited in the above Invention 2, wherein the resin indices $C_1$ and $C_2$ of the magnetic carrier satisfy the following formula (2) (Invention 3):

$$C_1/C_2=1.05 \text{ to } 1.40 \quad (2).$$

Also, according to the present invention, there is provided the magnetic carrier for an electrophotographic developer as recited in the above Invention 2 or 3, wherein an electric resistance value of the magnetic carrier is $1.0\times10^6$ to $1.0\times10^{16}$ Ωcm as measured by applying a voltage of 100 V thereto (Invention 4).

Also, according to the present invention, there is provided the magnetic carrier for an electrophotographic developer as recited in any one of the above Inventions 1 to 4, further comprising a resin coating layer produced from at least one resin selected from the group consisting of a silicone-based resin, an acrylic resin and a styrene-acrylic resin, the resin coating layer being formed on a surface of the respective spherical composite core particles or on a surface of the respective spherical composite particles (Invention 5).

Further, according to the present invention, there is provided a two-component system developer comprising the magnetic carrier for an electrophotographic developer as recited in any one of the above Inventions 2 to 5 and a toner (Invention 6).

Furthermore, according to the present invention, there is provided a process for producing the magnetic carrier for an electrophotographic developer as recited in the above Invention 1, comprising the step of reacting at least ferromagnetic iron oxide fine particles having a compressed density CD of 2.3 to 3.0 $g/cm^3$, a phenol compound and an aldehyde compound in an aqueous medium in the presence of a basic catalyst to produce spherical composite core particles comprising the ferromagnetic iron oxide fine particles and a cured phenol resin (Invention 7).

Still furthermore, according to the present invention, there is provided a process for producing the magnetic carrier for an electrophotographic developer as recited in any one of the above Inventions 2 to 4, comprising the steps of:

reacting at least ferromagnetic iron oxide fine particles having a compressed density CD of 2.3 to 3.0 $g/cm^3$, a phenol compound and an aldehyde compound in an aqueous medium in the presence of a basic catalyst to produce spherical composite core particles comprising the ferromagnetic iron oxide fine particles and a cured phenol resin;

then adding an acid aqueous solution comprising an acid having an acid dissociation constant pKa of 3 to 6 as an acid catalyst and a methylol melamine aqueous solution to the aqueous medium comprising the resulting spherical composite core particles to form a coating layer comprising a melamine resin on a surface of the respective spherical composite core particles; and further subjecting the resulting particles to heat treatment in an inert atmosphere at a temperature of 150 to 250° C. under a degree of the reduced pressure of 40 to 80 kPa (Invention 8).

Advantageous Effects of Invention

The magnetic carrier according to the Invention 1 reduces dispersion in magnetization value thereof, and therefore can be suitably used as a magnetic carrier for an electrophotographic developer.

The magnetic carrier according to the Invention 2 reduces dispersion in magnetization value thereof and can exhibit an electric charge amount, an electric resistance value and an outermost surface strength as desired by controlling a coating ratio of the melamine resin coating layer formed on a surface of the respective carrier particles, and therefore can be suitably used as a magnetic carrier for an electrophotographic developer.

The magnetic carrier according to the Invention 3 reduces dispersion in magnetization value thereof and can exhibit an electric charge amount, an electric resistance value and an outermost surface strength as desired by controlling a coating ratio of the melamine resin coating layer formed on a surface of the respective carrier particles, and therefore can be suitably used as a magnetic carrier for an electrophotographic developer.

The magnetic carrier according to the Invention 4 reduces dispersion in magnetization value thereof and can exhibit an electric charge amount, an electric resistance value and an outermost surface strength as desired by controlling a coating ratio of the melamine resin coating layer formed on a surface of the respective carrier particles, and therefore can be suitably used as a magnetic carrier for an electrophotographic developer.

The resin-coated magnetic carrier according to the Invention 5 is capable of suppressing carrier adhesion, can be prevented toner spent and can exhibit a further enhanced durability, and therefore can be suitably used as a magnetic carrier for an electrophotographic developer.

The two-component system developer according to the Invention 6 comprises the magnetic carrier that is excellent in durability, and therefore can be suitably used as a developer coping with miniaturization of the apparatus and higher quality image.

The process for producing a magnetic carrier according to the Invention 7 can provide a magnetic carrier for an electrophotographic developer which reduces dispersion in magnetization value thereof owing to improvement in dispersibility of ferromagnetic iron oxide fine particles therein, and therefore can be suitably used as the production process of the magnetic carrier.

The process for producing a magnetic carrier according to the Invention 8 can provide a magnetic carrier for an electrophotographic developer which reduces dispersion in magnetization value thereof owing to improvement in dispersibility of ferromagnetic iron oxide fine particles therein and can exhibit an electric charge amount, an electric resistance value and an outermost surface strength as desired by controlling a coating ratio of the melamine resin coating layer formed on a surface of the respective carrier particles, and therefore can be suitably used as a process for producing a magnetic carrier.

DESCRIPTION OF EMBODIMENTS

The present invention is described in detail below.

First, the magnetic carrier for an electrophotographic developer (hereinafter referred to merely as a "magnetic carrier") is described.

The magnetic carrier for an electrophotographic developer according to the present invention satisfies the formula: $\sigma_1-\sigma_0=-2$ to 0 ($Am^2/kg$; the unit is hereinafter omitted) wherein $\sigma_0$ represents a saturation magnetization ($Am^2/kg$) of the Carrier particles having a particle diameter in the vicinity of the average particle diameter of the magnetic carrier for an electrophotographic developer; and $\sigma_1$ represents a saturation magnetization ($Am^2/kg$) of the carrier particles having a particle diameter of less than 20 μm. When the value of $\sigma_1-\sigma_0$, that is, represents dispersion in saturation magnetization of the magnetic carrier, is lower than −2, i.e., larger in minus value than −2, carrier adhesion of the small-size carrier particles having a particle diameter of not more than 20 μm tend to be caused, so that the resulting images tend to be considerably deteriorated in image quality. On the other hand, it may be technically difficult to obtain the magnetic carrier having the value of $\sigma_1-\sigma_0$ of more than 0. The value of $\sigma_1-\sigma_0$ of the magnetic carrier is preferably −1.5 to 0, and more preferably −1 to 0.

In addition, the magnetic carrier for an electrophotographic developer according to the present invention preferably satisfies the formula: $\sigma_2-\sigma_0=-2$ to 0 wherein $\sigma_2$ represents a saturation magnetization ($Am^2/kg$) of the carrier particles having a particle diameter of more than 75 μm. When the value of $\sigma_2-\sigma_0$ is lower than −2, i.e., larger in minus value than −2, carrier adhesion of the small-size carrier particles having a particle diameter of not more than 20 μm tend to be caused, so that the resulting images tend to be considerably deteriorated in image quality. On the other hand, it may be technically difficult to obtain the magnetic carrier having the value of $\sigma_2-\sigma_0$ of more than 0. The value of $\sigma_2-\sigma_0$ of the magnetic carrier is preferably −1.5 to 0, and more preferably −1 to 0. Meanwhile, the method of measuring the values of $\sigma_0$, $\sigma_1$ and $\sigma_2$ is described below in Examples.

The magnetic carrier according to the present invention has an average particle diameter of 20 to 60 μm. When the average particle diameter of the magnetic carrier is less than 20 μm, the magnetic carrier tends to be secondary aggregation. When the average particle diameter of the magnetic carrier is more than 60 μm, the magnetic carrier tends to be deteriorated in mechanical strength, or tends to fail to obtain a clear image. The average particle diameter of the magnetic carrier is preferably 20 to 50 μm.

The magnetic carrier according to the present invention preferably has a shape factor SF1 of 100 to 120 and a shape factor SF2 of 100 to 120. The shape factor SF1 is more preferably 100 to 110, and the shape factor SF2 is more preferably 100 to 110. Meanwhile, the shape factors SF1 and SF2 may be determined by the method described in the below-mentioned Examples.

The shape factor SF1 represents a degree of roundness of particles, whereas the shape factor SF2 represents a degree of unevenness on a surface of particles. Therefore, when the particle shape is deviated from a circle (sphere), the shape factor SF1 is increased, whereas when the degree of unevenness on the surface of the particles becomes large, the shape factor SF2 is also increased. The respective shape factors are close to 100 as the particle shape approaches a complete round (sphere).

When the shape of the magnetic carrier approaches a sphere and the degree of unevenness on the surface of the magnetic carrier become small, a magnetic brush in the developing zone becomes more uniform, so that the carrier adhesion is effectively prevented. When the shape factor SF1 of the magnetic carrier exceeds 120 or when the shape factor SF2 of the magnetic carrier exceeds 120, it may be difficult to form a uniform resin coating layer thereon, so that the resulting carrier tends to exhibit uneven electric charge amount and resistance, and therefore fail to obtain high-resolution images. Further, in such a case, there occurs such a tendency that the adhesion strength between the resin coating layer and the particles is deteriorated, thereby failing to attain a sufficient durability.

The bulk density of the magnetic carrier according to the present invention is preferably not more than 2.5 $g/cm^3$ and more preferably 1.0 to 2.0 g/cm$^3$, and the true specific gravity thereof is preferably 2.5 to 4.5 and more preferably 3.0 to 4.0.

The magnetic carrier according to the present invention preferably has a saturation magnetization value of 30 to 80 Am$^2$/kg and more preferably 40 to 70 Am$^2$/kg as measured by applying an external magnetic field of 79.58 kA/m (1 kOe) thereto. Also, the magnetic carrier according to the present invention preferably has a saturation magnetization value of 40 to 90 Am$^2$/kg and more preferably 50 to 80 Am$^2$/kg as measured by applying an external magnetic field of 795.8 kA/m (10 kOe) thereto. Further, the magnetic carrier according to the present invention preferably has a residual magnetization value of 1 to 20 Am$^2$/kg and more preferably 1 to 10 Am$^2$/kg as measured by applying an external magnetic field of 79.58 kA/m (1 kOe) thereto. Also, the magnetic carrier according to the present invention preferably has a residual magnetization value of 1 to 20 Am$^2$/kg and more preferably 1 to 10 Am$^2$/kg as measured by applying an external magnetic field of 795.8 kA/m (10 kOe) thereto.

The content of the ferromagnetic iron oxide fine particles in the magnetic carrier according to the present invention is preferably 80 to 99% by weight based on the weight of the magnetic carrier. When the content of the ferromagnetic iron oxide fine particles in the magnetic carrier is less than 80% by weight, the resin component in the magnetic carrier tends to be comparatively increased, so that coarse particles tend to be produced. When the content of the ferromagnetic iron oxide fine particles in the magnetic carrier is more than 99% by weight, the resin component in the magnetic carrier tends to be comparatively reduced, so that the resulting particles may fail to exhibit a sufficient strength. The content of the ferromagnetic iron oxide fine particles in the magnetic carrier is more preferably 85 to 99% by weight.

The resin index $C_1$ of the magnetic carrier according to the Invention 1 is preferably 35 to 80%, more preferably 40 to 75%, and still more preferably 45 to 70%. Meanwhile, the "resin index" as used in the present invention is determined by the method described below in Examples, and means an index showing a proportion of a resin in the composite core particles or the composite particles which is defined by a ratio of an area of a resin portion to a whole area in a backscattered electron image of the respective particles when observing the particles using a scanning electron microscope. Meanwhile, the resin index as observed at an acceleration voltage of 1 kV by a scanning electron microscope is represented by $C_1$, whereas the resin index as observed at an acceleration voltage of 2 kV by a scanning electron microscope is represented by $C_2$.

When the resin index $C_1$ of the magnetic carrier according to the Invention 1 is less than 35%, the wettability of the coating resin to the magnetic carrier core material tends to be insufficient, or it may be difficult to uniformly coat the magnetic carrier core material with the coating resin because the coating resin tends to enter into recessed portions on the magnetic carrier core material, so that the resulting magnetic carrier tends to fail to exhibit stable electric charge amount and electric resistance characteristics. In addition, the spherical composite core particles tend to have a weak strength on an outermost surface thereof, so that there tends to arise such a problem that when stirring a developer, the magnetic carrier tend to be insufficient to peeling of the coating resin layer therefrom. On the other hand, when the resin index $C_1$ of the magnetic carrier according to the Invention 1 is more than 80%, a fine uneven structure on the surface of the respective spherical composite core particles tends to be decreased, so that it may be therefore difficult to attain a anchor effect, and there tends to arise such a problem that when stirring a developer, the magnetic carrier tend to be insufficient to peeling of the coating resin layer therefrom. In addition, the magnetic carrier tends to exhibit a high electric resistance value, so that it may be difficult to control an electric resistance of the magnetic carrier by coating the particles with the resin. In the present invention, by controlling the resin index $C_1$ of the spherical composite core particles, it is possible to easily control an electric resistance of the magnetic carrier by coating the particles with the resin, or suppress deterioration such as peeling of the coating resin layer, etc.

The electric resistance value of the magnetic carrier according to the Invention 1 is preferably $1.0\times10^5$ to $1.0\times10^{15}$ Ωcm, and more preferably $1.0\times10^6$ to $1.0\times10^{14}$ Ωcm. When the electric resistance value of the magnetic carrier is less than $1.0\times10^5$ Ωcm, there tends to undesirably arise such a problem that the magnetic carrier is attached onto an image forming portion of a photoreceptor owing to electric charge injected from a sleeve thereof, or a latent image charge is escaped through the magnetic carrier, resulting in occurrence of image defect and image deletion. On the other hand, when the electric resistance value of the magnetic carrier is more than $1.0\times10^{15}$ Ωcm, the edge effect of solid images tends to occur, so that solid image portions tend to be hardly reproduced.

The magnetic carrier according to the Invention 1 preferably has a water content of 0.1 to 0.8% by weight. When the water content of the magnetic carrier is less than 0.1% by weight, there is present no adequate amount of water absorbed in the magnetic carrier, so that a so-called charge-up phenomenon tends to occur, thereby causing deterioration of the resulting images. On the other hand, when the water content of the magnetic carrier is more than 0.8% by weight, the electric charge amount of the magnetic carrier tends to be unstable depending upon variation of environmental conditions, so that scattering of the toner tends to be caused. The water content of the magnetic carrier according to the Invention 1 is more preferably 0.2 to 0.7% by weight.

The magnetic carrier according to the Invention 2 preferably has a water content of 0.3 to 1.0% by weight. When the water content of the magnetic carrier is less than 0.3% by weight, there is present no adequate amount of water absorbed in the magnetic carrier, so that a so-called charge-up phenomenon tends to occur, thereby causing deterioration of the resulting images. On the other hand, when the water content of the magnetic carrier is more than 1.0% by weight, the electric charge amount of the magnetic carrier tends to be unstable depending upon variation of environmental conditions, so that scattering of the toner tends to be caused. The water content of the magnetic carrier according to the Invention 2 is more preferably 0.4 to 0.8% by weight.

The magnetic carrier according to the Invention 2 has a resin index $C_1$ of 50 to 90%, preferably 55 to 90%, and more preferably 60 to 88%.

When the resin index $C_1$ of the magnetic carrier is less than 50%, there tend to occur defects such as insufficient or uneven electric charge amount and electric resistance value of the magnetic carrier, and the electric resistance value tends to have a high dependency on voltage applied, so that the resulting images generally tend to be inferior to gradation and therefore become undesirable. Also, the resulting magnetic carrier tends to be insufficient in outermost surface strength thereof. In addition, when coating the surface of the particles with a resin, the particles tend to be deteriorated in adhesion to the resin, so that it is not possible to obtain a uniform resin coating layer on the respective particles. On the other hand, when the resin index $C_1$ of the magnetic carrier is more than 90%, the magnetic carrier tends to be excessively increased in electric charge amount and electric resistance value. In addition, there tends to arise such a problem that when coating the surface of the particles with a resin, it may be difficult to attain an anchor effect of the resin thereon, so that the resulting magnetic carrier tends to be deteriorated in strength.

In the magnetic carrier according to the Invention 3, the ratio of the resin index $C_1$ to the resin index $C_2$ ($C_1/C_2$) is 1.05 to 1.40, preferably 1.07 to 1.35, and more preferably 1.10 to 1.30.

When the ratio of the resin index $C_1$ to the resin index $C_2$ ($C_1/C_2$) is more than 1.40, the melamine resin coating layer formed on the surface of the magnetic carrier particles tends to be thinned or become uneven, and therefore if defects such as peeling of the coating layer, etc., are caused when used for a long period of time, there tends to occur undesirable carrier adhesion owing to leakage phenomenon. On the other hand, when the ratio of the resin index $C_1$ to the resin index $C_2$ ($C_1/C_2$) is less than 1.05, the melamine resin coating layer formed on the surface of the magnetic carrier particles tends to be partially or wholly thickened, so that it may be difficult to control an electric charge amount and an electric resistance value of the magnetic carrier.

The electric resistance value of the magnetic carrier according to the Invention 4 is preferably $1.0\times10^6$ to $1.0\times10^{16}$ Ωcm, more preferably $5.0\times10^6$ to $1.0\times10^{15}$ Ωcm, and still more preferably $1.0\times10^7$ to $1.0\times10^{14}$ Ωcm as measured by applying a voltage of 100 V thereto. When the electric resistance value of the magnetic carrier is less than $1.0\times10^6$ Ωcm, there tends to undesirably arise such a problem that the magnetic carrier is attached onto an image forming portion of a photoreceptor owing to electric charge injected from a sleeve thereof, or a latent image charge is escaped through the magnetic carrier, resulting in occurrence of image defect and image deletion. On the other hand, when the electric resistance value of the magnetic carrier is more than $1.0\times10^{16}$ Ωcm, the edge effect of solid images tends to occur, so that solid image portions tend to be hardly reproduced.

The electric resistance value of the magnetic carrier produced by coating a surface of the respective spherical composite particles with a resin according to the Invention 5 is preferably $1.0\times10^7$ to $1.0\times10^{16}$ Ωcm, and more preferably $1.0\times10^8$ to $1.0\times10^{15}$ Ωcm as measured by applying a voltage of 100 V thereto. When the electric resistance value of the magnetic carrier is less than $1.0\times10^7$ Ωcm, there tends to undesirably arise such a problem that the magnetic carrier is attached onto an image forming portion of a photoreceptor owing to electric charge injected from a sleeve thereof, or a latent image charge is escaped through the magnetic carrier, resulting in occurrence of image defect and image deletion. On the other hand, when the electric resistance value of the magnetic carrier is more than $1.0\times10^{16}$ Ωcm, the edge effect of solid images tends to occur, so that solid image portions tend to be hardly reproduced.

Next, the process for producing the magnetic carrier for an electrophotographic developer according to the present invention is described.

That is, the magnetic carrier for an electrophotographic developer comprising the spherical composite core particles according to the Invention 1 may be produced by reacting a phenol compound and an aldehyde compound with each other in an aqueous medium in the co-existence of ferromagnetic iron oxide fine particles having a compressed density CD of 2.3 to 3.0 g/cm$^3$ in the presence of a basic catalyst to thereby obtain the spherical composite core particles comprising the ferromagnetic iron oxide fine particles and a cured phenol resin (Invention 7).

The compressed density CD of the ferromagnetic iron oxide fine particles used in the present invention is 2.3 to 3.0 g/cm$^3$. When the compressed density CD of the ferromagnetic iron oxide fine particles is less than 2.3 g/cm$^3$, the magnetic carrier produced using the ferromagnetic iron oxide fine particles tends to fail to obtain particles having a particle diameter of not more than 20 μm and particles having a particle diameter of not less than 70 μm which can exhibit a sufficient magnetization value. On the other hand, when the compressed density CD of the ferromagnetic iron oxide fine particles is more than 3.0 g/cm$^3$, it may be difficult to industrially produce the aimed magnetic carrier therefrom. The compressed density CD of the ferromagnetic iron oxide fine particles is preferably 2.4 to 3.0 g/cm$^3$, and more preferably 2.5 to 3.0 g/cm$^3$. Meanwhile, the compressed density CD of the ferromagnetic iron oxide fine particles may be determined by the method described below in Examples.

The process for producing the ferromagnetic iron oxide fine particles used in the present invention is described below.

The ferromagnetic iron oxide fine particles used in the present invention may be produced by conventionally known methods. For example, the ferromagnetic iron oxide fine particles are produced which comprises the steps of mixing an aqueous ferrous salt solution and an aqueous alkali hydroxide solution with each other for subjecting to the neutralization treatment, blowing an oxygen-containing gas, preferably air, through the resultant aqueous ferrous salt reaction solution containing a ferrous hydroxide colloid to oxidize ferrous ions contained therein, removing a soluble salt from the slurry solution containing ferromagnetic iron oxide fine particles by using decantation, filter thickener, or the like, further subjecting to wet pulverization using a pulverizer such as a ball mill, attritor and a TK homomixer, and then drying thereby, obtaining the ferromagnetic iron oxide fine particles.

In the present invention, the slurry solution obtained after completion of the oxidation reaction is subjected to wet pulverization using a pulverizer such as a ball mill, an attritor and a TK homomixer.

In the wet pulverization, it is required to apply a sufficient shear force to the magnetic iron oxide particles in the slurry solution. For example, when using a TK homomixer, it is required to treat the particles at a rotating speed of not less than 3,000 rpm. When using a ball mill or an attritor in which the dispersing shear force required may frequently vary depending upon a particle diameter of media used therein, it is required to use such media having a particle diameter as small as possible. The particle diameter of the media is not more than 1 cm, and preferably not more than 5 mm. The treating time of these pulverizers is preferably not less than 1 hr.

The drying treatment may be conducted using various dryers such as a flash dryer, a freeze dryer and a vacuum dryer. Of these dryers, in the present invention, the flash dryer is preferably used. The flash dryer is capable of drying the particles while appropriately dispersing the particles so as not to firmly coagulate the particles together, and therefore the use of the flash dryer is preferred to efficiently produce the ferromagnetic iron oxide fine particles having a compressed density that lies within the specific range.

In order to obtain the ferromagnetic iron oxide fine particles having an excellent dispersibility, the concentration of the slurry solution containing the ferromagnetic iron oxide fine particles obtained after the wet pulverization treatment when drying the slurry solution containing the magnetic iron oxide particles using the flash dryer has a large influence on the dispersibility. The concentration of the slurry solution is preferably as low as possible, and the concentration of the ferromagnetic iron oxide fine particles in the slurry solution is not more than 50%, preferably not more than 30%, and more preferably not more than 20%. In addition, it is required to control the temperature within the dryer such that the drying is completed for a short period of time. The drying temperature within the dryer is not lower than 100° C., and preferably not lower than 150° C., and the drying time is preferably as short as possible, and is not more than 10 min, and preferably not more than 5 min.

The ferromagnetic iron oxide fine particles used in the present invention may be produced by removing a soluble salt from the slurry solution containing ferromagnetic iron oxide fine particles obtained by conventionally known methods using decantation, filter thickener, or the like; further subjecting the thus obtained product to wet pulverization using a pulverizer such as a ball mill, an attritor and a TK homomixer; and then drying the resulting particles using a flash dryer, a freeze dryer, a vacuum dryer or the like, thereby obtaining ferromagnetic iron oxide fine particles having a good dispersibility.

The compressed density CD of the ferromagnetic iron oxide fine particles has a close relationship with a dispersibility of the ferromagnetic iron oxide fine particles. That is, since the spherical composite core particles used in the present invention are produced from the ferromagnetic iron oxide fine particles and the cured phenol resin, it is required that the ferromagnetic iron oxide fine particles are excellent in dispersibility in the above resin.

In general, when the ferromagnetic iron oxide fine particles has a poor dispersibility, the particles tend to be aggregated together, so that the granulated particles tend to be included mainly in particles having a particle diameter of not more than 20 μm and particles having a particle diameter of not less than 75 μm. The granulated particles comprising such aggregated particles tend to be hardly packed to a sufficient extent, so that a content of the ferromagnetic iron oxide fine particles in the magnetic carrier tends to be hardly increased, resulting in deterioration of a magnetization value of the resulting magnetic carrier. In particular, in the case where the magnetic carrier has a small particle diameter of not more than 20 μm, the magnetization value of the magnetic carrier tends to be further reduced because its magnetization value per each particle is low by nature, so that there tends to arise such a defect that the carrier adhesion is readily caused.

In the present invention, by controlling a compressed density CD of the ferromagnetic iron oxide fine particles, it is possible to obtain ferromagnetic iron oxide fine particles having an excellent dispersibility. As a result, it is possible to reduce dispersion in magnetization value of the spherical composite particles.

The average particle diameter of the ferromagnetic iron oxide fine particles used in the present invention is preferably 0.05 top 3.0 μm. When the average particle diameter of the ferromagnetic iron oxide fine particles is less than 0.05 μm, the ferromagnetic iron oxide fine particles tend to have an increased coagulation force, so that it may be difficult to produce the spherical composite core particles. When the average particle diameter of the ferromagnetic iron oxide fine particles is more than 3.0 μm, the ferromagnetic iron oxide fine particles tend to be readily desorbed from the surface of the magnetic carrier. The average particle diameter of the ferromagnetic iron oxide fine particles is more preferably 0.1 to 2.0 μm.

Examples of the ferromagnetic iron oxide fine particles used in the present invention include magnetoplumbite-type iron oxide fine particles (such as strontium ferrite particles and barium ferrite particles), magnetite particles, and the like. Among these particles, preferred are magnetite particles.

The ferromagnetic iron oxide fine particles used in the present invention may have a particle shape such as a spherical shape, a plate shape, a hexahedral shape, an octahedral shape, a polyhedral shape and the like. Among these particle shapes, preferred is a spherical shape.

In the present invention, two or more kinds of ferromagnetic iron oxide fine particles which are different in average particle diameter and/or particle shape from each other may be used in the form of a mixture thereof.

In the present invention, the above ferromagnetic iron oxide fine particles may be used in combination with non-magnetic particles such as hematite.

In general, the ferromagnetic iron oxide fine particles comprise a slight amount of impurities derived from the starting materials. Examples of the impurity components include $SiO_2$, Ca, Mn, Na and Mg, and anion components such as sulfate ions and chloride ions. These components tend to impair an environmental stability on charge characteristics of the magnetic carrier. Therefore, the ferromagnetic iron oxide fine particles preferably have a high purity such that the content of impurities therein is not more than 2.0%.

The ferromagnetic iron oxide fine particles used in the present invention are preferably previously subjected to lipophilic treatment. When using the ferromagnetic iron oxide fine particles subjected to no lipophilic treatment, it may be sometimes difficult to obtain composite particles having a spherical shape.

The lipophilic treatment may be suitably performed by the method of treating the ferromagnetic iron oxide fine particles with a coupling agent such as a silane-based coupling agent and a titanate-based coupling agent, or the method of dispersing the ferromagnetic iron oxide fine particles in an aqueous solvent comprising a surfactant to adsorb the surfactant onto a surface of the respective particles.

Examples of the silane-based coupling agent include those having a hydrophobic group, an amino group or an epoxy group. Specific examples of the silane-based coupling agent having a hydrophobic group include vinyl trichlorosilane, vinyl triethoxysilane and vinyl-tris(β-methoxy)silane.

Examples of the silane-based coupling agent having an amino group include γ-aminopropyl triethoxysilane, N-β-(aminoethyl)-γ-aminopropyl trimethoxysilane, N-β-(aminoethyl)-γ-aminopropylmethyl dimethoxysilane and N-phenyl-γ-aminopropyl trimethoxysilane.

Examples of the silane-based coupling agent having an epoxy group include γ-glycidoxypropylmethyl diethoxysilane, γ-glycidoxypropyl trimethoxysilane and β-(3,4-epoxycyclohexyl) trimethoxysilane.

Examples of the titanate-based coupling agent include isopropyl triisostearoyl titanate, isopropyl tridecylbenzenesulfonyl titanate and isopropyl tris(dioctylpyrophosphate) titanate.

As the surfactant, there may be used commercially available surfactants. Among these surfactants, those surfactants having a functional group that is capable of directly bonding to a surface of the respective ferromagnetic iron oxide fine particles, or bonding to a hydroxyl group present on the surface of the respective ferromagnetic iron oxide fine particles, and the ionicity of the surfactants is preferably cationic or anionic.

Although the objects of the present invention can be achieved by using any of the above lipophilic treatments, from the viewpoint of good adhesion to phenol resins, the treatments with the silane-based coupling agent having an amino group or an epoxy group are preferred.

The treating amount of the above coupling agent or surfactant is preferably 0.1 to 10% by weight based on the weight of the ferromagnetic iron oxide fine particles to be treated.

The process for producing the spherical composite core particles from the ferromagnetic iron oxide fine particles according to the Invention 7 and the cured phenol resin is as follows.

Examples of the phenol compound used in the present invention include compounds having a phenolic hydroxyl group, e.g., phenol; alkyl phenols such as m-cresol, p-cresol, p-tert-butyl phenol, o-propyl phenol, resorcinol and bisphenol A; and halogenated phenols obtained by replacing a part or whole of alkyl groups of the above compounds with a chlorine atom or a bromine atom. Among these phenol compounds, from the viewpoint of a good shape property of the resulting particles, most preferred is phenol.

Examples of the aldehyde compound used in the present invention include formaldehyde that may be in the form of either formalin or para-aldehyde, acetaldehyde, furfural, glyoxal, acrolein, crotonaldehyde, salicylaldehyde and glutaraldehyde. Among these aldehyde compounds, most preferred is formaldehyde.

The molar ratio of the aldehyde compound to the phenol compound is preferably 1.0 to 4.0. When the molar ratio of the aldehyde compound to the phenol compound is less than 1.0, it may be difficult to produce the particles as aimed, or since curing of the resin hardly proceeds, there is a tendency that the obtained particles have a low strength. When the molar ratio of the aldehyde compound to the phenol compound is more than 4.0, there is a tendency that the amount of the unreacted aldehyde compound remaining in the aqueous medium after the reaction is increased. The molar ratio of the aldehyde compound to the phenol compound is more preferably 1.2 to 3.0.

As the basic catalyst used in the present invention, there may be mentioned those basic catalysts ordinarily used for production of resol resins. Examples of the basic catalyst include aqueous ammonia, and alkyl amines such as hexamethylenetetramine, dimethyl amine, diethyl triamine and polyethylene imine. Among these basic catalysts, especially preferred is aqueous ammonia. The molar ratio of the basic catalyst to the phenol compound is preferably 0.05 to 1.50. When the molar ratio of the basic catalyst to the phenol compound is less than 0.05, curing of the resin tends to hardly proceed sufficiently, so that it may be difficult to granulate the particles. When the molar ratio of the basic catalyst to the phenol compound is more than 1.50, the structure of the phenol resin tends to be adversely affected, resulting in deteriorated granulation of the particles, so that it may be difficult to obtain particles having a large particle diameter.

The amount of the ferromagnetic iron oxide fine particles that are allowed to coexist when reacting the above phenol compound and aldehyde compound in the presence of a basic catalyst is preferably 75 to 99% by weight based on a total amount of the ferromagnetic iron oxide fine particles, phenol compound and aldehyde compound, and more preferably 78 to 99% by weight from the viewpoint of a high strength of the resulting magnetic carrier.

In the present invention, the reaction for production of the spherical composite core particles may be carried out in the aqueous medium. The concentration of solid components in the aqueous medium is preferably controlled to 30 to 95% by weight and more preferably 60 to 90% by weight.

In the present invention, the reaction for production of the spherical composite core particles may be conducted as follows. That is, the phenol compound, the aldehyde compound, water and the ferromagnetic iron oxide fine particles are sufficiently stirred and mixed with each other, and then the basic catalyst is added to the obtained mixture. The reaction solution to which the basic catalyst is added is heated while stirring to the temperature range of 60 to 95° C., and reacted in the temperature range for 30 to 300 min, preferably 60 to 240 min, and the resulting phenol resin is subjected to polycondensation reaction for curing thereof.

In the above reaction, in order to obtain the spherical composite core particles having a high sphericity, the reaction temperature is preferably gradually increased. The temperature rise rate in the reaction is preferably 0.5 to 1.5° C./min and more preferably 0.8 to 1.2° C./min.

Also, in the above reaction, in order to well control the particle size of the obtained particles, the stirring speed of the reaction solution is suitably adjusted. The stirring speed is preferably 100 to 1000 rpm.

After completion of curing the resin, the reaction product is cooled to a temperature of not more than 40° C., thereby obtaining a water dispersion of the spherical composite core particles in which the ferromagnetic iron oxide fine particles are well dispersed in the binder resin and exposed to the surface of the respective spherical composite core particles.

The thus obtained water dispersion of the spherical composite core particles is subjected to solid-liquid separation by ordinary methods such as filtration and centrifugal separation, and then the obtained solids are washed and dried, and further subjected to heat treatment, thereby obtaining the spherical composite core particles as aimed.

The resin index $C_1$ of the spherical composite core particles according to the present invention is preferably in the range of 35 to 80%. As the method of controlling the resin index $C_1$ of the spherical composite core particles, there may be mentioned the following method.

The spherical composite core particles are preferably subjected to heat treatment in order to further cure the resin therein. In particular, the heat treatment is preferably conducted under reduced pressure or in an inert atmosphere for the purpose of preventing oxidation of the ferromagnetic iron oxide fine particles. Furthermore, in the present invention, it has been found that the resin index $C_1$ of the spherical composite core particles can be well controlled by the heat treatment.

That is, the resin index $C_1$ of the spherical composite core particles can be controlled by adjusting a degree of the reduced pressure, a heat-treating temperature and a heat-treating time in the heat treatment.

The spherical composite particles as described in Japanese Patent Application Laid-Open (KOKAI) No. 2-220068 (1990) and Japanese Patent Application Laid-Open (KOKAI) No. 2000-199985 which are produced from magnetic particles and a phenol resin are subjected to heat treatment at a very high degree of the reduced pressure (665 Pa). As a result, the thus treated particles tend to exhibit a resin index $C_1$ of lower than 35% and therefore tend to cause deterioration in wettability of a coating resin to the magnetic carrier core material, so that it may be difficult to uniformly coat the particles with the resin and attain stable electric charge amount and electric resistance characteristics of the resulting magnetic carrier. In addition, the resulting spherical composite particles tend to have a weak outermost surface strength, so that there tends to arise such a problem that when stirring a developer, the magnetic carrier suffers from deterioration such as peeling of the coating resin layer therefrom. For this reason, there also tends to occur such a problem that these conventional particles are insufficient to meet the recent demand for magnetic carriers having a longer service life for obtaining high-quality images.

The heat treatment of the spherical composite core particles according to the present invention is conducted in an inert atmosphere such as a nitrogen gas in a temperature range of 150 to 250° C. under a degree of the reduced pressure of 40 to 80 kPa for 1 to 7 hr, so that it is possible to control a resin index $C_1$ of the spherical composite core particles within the range of 35 to 80%.

When the magnetic carrier core material is heat-treated under a high degree of reduced pressure, i.e., under a pressure of less than 40 kPa, the amount of the resin present on the surface of the magnetic carrier core material tends to be considerably reduced, so that the wettability of the coating resin to the magnetic carrier core material tends to be deteriorated or the coating resin tends to enter into recessed portions on the magnetic carrier core material. As a result, it may be difficult to uniformly coat the magnetic carrier core material with the resin, and therefore the resulting magnetic carrier tends to be impaired stable electric charge amount and electric resistance. Further, the outermost surface of the magnetic carrier core material tends to have a weak strength, so that the obtained magnetic carrier tends to be insufficient to peeling of the coating layer therefrom upon stirring the developer. On the other hand, when the magnetic carrier core material is heat-treated under a low degree of reduced pressure, i.e., under pressure of more than 80 kPa, the fine unevenness formed on the surface of the respective magnetic carrier core material particles tends to become excessively small, so that the anchor effect on the surface of the respective particles tends to be hardly attained. Thus, the resulting magnetic carrier tends to be insufficient to peeling of the coating layer therefrom upon stirring the developer. In addition, the electric resistance of the magnetic carrier tends to be increased, so that it may be difficult to control the electric resistance by coating with the resin. Therefore, the reduced pressure upon subjecting the magnetic carrier core material to heat treatment is preferably 40 to 80 kPa, and more preferably 45 to 75 kPa.

When the magnetic carrier core material is subjected to heat treatment at a temperature higher than 250° C., the amount of the resin present on the surface of the magnetic carrier core material tends to be considerably reduced, so that the wettability of the coating resin to the magnetic carrier core material tends to be deteriorated or the coating resin tends to enter into recessed portions on the magnetic carrier core material. As a result, it may be difficult to uniformly coat the magnetic carrier core material with the resin, and therefore the resulting magnetic carrier tends to fail to exhibit stable electric charge amount and electric resistance. Further, the outermost surface of the magnetic carrier core material tends to have a weak strength, so that the obtained magnetic carrier tends to be insufficient to peeling of the coating layer therefrom upon stirring the developer. On the other hand, when the magnetic carrier core material is heat-treated at a temperature of lower than 150° C., the fine unevenness formed on the surface of the respective magnetic carrier core material particles tends to become excessively small owing to the presence of an excessive amount of the resin on the surface thereof, so that the anchor effect on the surface of the respective particles tends to be hardly attained. Thus, the resulting magnetic carrier tends to be insufficient to peeling of the coating layer therefrom upon stirring the developer. In addition, the electric resistance of the magnetic carrier tends to be increased, so that it may be difficult to control the electric resistance by coating with the resin. Therefore, the heat-treating temperature of the magnetic carrier core material is preferably 150 to 250° C., and more preferably 170 to 230° C.

When the magnetic carrier core material is subjected to heat treatment for a time period of more than 7 hr, the amount of the resin present on the surface of the magnetic carrier core material tends to be considerably reduced, so that the wettability of the coating resin to the magnetic carrier core material tends to be deteriorated or the coating resin tends to enter into recessed portions on the magnetic carrier core material. As a result, it may be difficult to uniformly coat the magnetic carrier core material with the resin, and therefore the resulting magnetic carrier tends to fail to exhibit stable electric charge amount and electric resistance. Further, the outermost surface of the magnetic carrier core material tends to have a weak strength, so that the obtained magnetic carrier tends to be insufficient to peeling of the coating layer therefrom upon stirring the developer. On the other hand, when the magnetic carrier core material is heat-treated for a time period of less than 1 hr, the fine unevenness formed on the surface of the respective magnetic carrier core material particles tends to become excessively small owing to the presence of an excessive amount of the resin on the surface thereof, so that the anchor effect on the surface of the respective particles tends to be hardly attained. Thus, the resulting magnetic carrier tends to be insufficient to peeling of the coating layer therefrom upon stirring the developer. In addition, the electric resistance of the magnetic carrier tends to be increased, so that it may be difficult to control the electric resistance by coating with the resin. Therefore, the heat-treating time of the magnetic carrier core material is preferably 1 to 7 hr, and more preferably 2 to 6 hr.

Meanwhile, in order to provide the inert atmosphere, there is preferably used an inert gas. Examples of the inert gas include nitrogen, helium, argon, a carbon dioxide gas, etc. From the industrial viewpoints, it is costly advantageous that the heat treatment is conducted while blowing a nitrogen gas into the reaction system, thereby obtaining the magnetic carrier having stable characteristics.

Next, the process for producing the spherical composite particles according to the Invention 2 which comprises the spherical composite core particles and the melamine resin coating layer formed on the surface of the respective spherical composite core particles is described (Invention 8).

That is, the magnetic carrier for an electrophotographic developer according to the Invention 8 may be produced by reacting a phenol compound and an aldehyde compound with each other in an aqueous medium in the co-existence of ferromagnetic iron oxide fine particles having a compressed density CD of 2.3 to 3.0 g/cm$^3$ in the presence of a basic catalyst to thereby obtain the spherical composite core particles comprising the ferromagnetic iron oxide fine particles and a phenol resin as a cured product; and then adding an acid aqueous solution comprising an acid having an acid dissociation constant pKa of 3 to 6 as an acid catalyst and a methylol melamine aqueous solution to the aqueous medium comprising the spherical composite core particles to form a coating layer formed of a melamine resin on the surface of the respective spherical composite core particles; and further subjecting the resulting particles to heat treatment in an inert atmosphere in a temperature range of 150 to 250° C. under a degree of the reduced pressure of 40 to 80 kPa.

The reaction for production of the spherical composite particles in which the melamine resin coating layer is formed on the surface of the respective spherical composite core particles is continuously carried out in the aqueous medium in which the above spherical composite core particles are produced. That is, while maintaining the reaction solution in a temperature range of 60 to 95° C., an acid solution comprising an acid having an acid dissociation constant pKa of 3 to 6 as an acid catalyst and a methylol melamine aqueous solution separately prepared by reacting melamine and an aldehyde compound in water are added thereto and reacted therewith while stirring for 30 to 300 min, preferably 60 to 240 min to form a melamine resin coating layer on the surface of the respective spherical composite core particles.

Next, the reaction product is cooled to a temperature of not higher than 40° C., and the thus obtained water dispersion of the spherical composite particles is subjected to solid-liquid separation by ordinary methods such as filtration and centrifugal separation, and then the obtained solids are washed and dried, and further subjected to heat treatment, thereby obtaining the spherical composite particles as aimed.

The amount of melamine added is preferably 0.1 to 5.0% by weight based on the spherical composite particles in order to well control the resin index $C_1$ and the ratio $C_1/C_2$.

In the method of adding the melamine to the aqueous medium comprising the above spherical composite core particles, if the water-insoluble melamine is directly added in a solid state to the aqueous medium, there are obtained the spherical composite particles comprising the spherical composite core particles whose surface is non-uniformly coated with the melamine resin coating layer. Therefore, the resulting spherical composite particles tend to fail to exhibit the resin index $C_1$ and the ratio $C_1/C_2$ as defined in the present invention (Patent Literatures 1, 2, 3 and 4).

Therefore, in the method of adding the melamine to the aqueous medium comprising the above spherical composite core particles, it is preferred to add a methylol melamine aqueous solution separately prepared by reacting melamine and an aldehyde compound in water. If the methylolation reaction rapidly proceeds in the aqueous solution, the aqueous solution tends to become whitely turbid owing to polycondensation reaction of methylol melamine, so that it may be difficult to form the thin uniform coating layer of the melamine resin on the surface of the respective spherical composite core particles. Therefore, the methylol melamine aqueous solution is preferably added in the form of a transparent aqueous solution in which the polymerization reaction has proceeded to a certain extent, to the aqueous medium comprising the spherical composite core particles.

The aldehyde compound used for forming the melamine coating layer may be selected from those which are also usable in the reaction for production of the above spherical composite core particles.

The molar ratio of the aldehyde compound to melamine in the methylol melamine aqueous solution is preferably 1 to 10, and the concentration of melamine in the methylol melamine aqueous solution is preferably 5 to 50% by weight.

The methylol melamine aqueous solution may be prepared as follows. That is, melamine and the aldehyde compound are added to water to obtain a reaction solution, and the obtained reaction solution is heated while stirring to a temperature of 40 to 80° C. The reaction solution is subjected to methylolation reaction in the above temperature range for 30 to 240 min, preferably for 60 to 180 min to produce the methylol melamine aqueous solution.

The above methylolation reaction of melamine is preferably slowly conducted. In the methylolation reaction, the temperature rise rate is preferably 0.5 to 1.5° C./min, and the stirring speed is preferably 100 to 1000 rpm.

In the present invention, as the acid catalyst, there may be suitably used a weak acid having an acid dissociation constant pKa of 3 to 6. Examples of the weak acid include formic acid, oxalic acid and acetic acid. Among these acids, most preferred is acetic acid. The content of the acid in the aqueous medium used for forming the composite particles is preferably 0.5 to 3% by weight.

The present invention is characterized in that the acid aqueous solution comprising the acid having an acid dissociation constant pKa of 3 to 6 as an acid catalyst and the methylol melamine aqueous solution are added to the aqueous medium comprising the above spherical composite core particles. That is, by adding both the aqueous solutions to the aqueous medium, the reaction and curing speed of methylol melamine become optimum, so that it is possible to form a thin uniform melamine resin coating layer on the surface of the respective spherical composite core particles comprising the ferromagnetic iron oxide fine particles and the cured phenol resin.

When using an acid catalyst generating a strong acid having an acid dissociation constant pKa of less than 3 such as, for example, ammonium chloride generating hydrochloric acid, it may be difficult to form the uniform melamine resin coating layer, so that the resulting spherical composite particles tend to fail to exhibit the resin index $C_1$ and the ratio $C_1/C_2$ as defined in the present invention (Patent Literatures 1, 2, 3 and 4). On the other hand, when using the acid catalyst having an acid dissociation constant pKa of more than 6, it may be difficult to form the melamine resin coating layer to a sufficient extent.

In addition, in order to form a thin uniform melamine resin coating layer on the surface of the respective spherical composite core particles, it is desirable to control a stirring speed of the reaction solution. The stirring speed of the reaction solution is preferably 100 to 1000 rpm.

The heat treatment of the spherical composite particles according to the present invention is preferably conducted in an inert atmosphere such as a nitrogen gas in a temperature range of 150 to 250° C. under a degree of the reduced pressure of 40 to 80 kPa for 1 to 7 hr.

Thus, by well controlling a degree of the reduced pressure, a heat-treating temperature and a heat-treating time among the heat treatment conditions, it is possible to obtain the spherical composite particles provided thereon with the melamine resin coating layer which have the resin index $C_1$ and the ratio $C_1/C_2$ as defined in the present invention. In the Inventions 1 to 4, in order to evaluate a coating condition of the resin present in the vicinity of the surface of the magnetic carrier, the "resin index" as described below in Examples is used. The "resin index" as used herein means an index relating to a proportion and a thickness of the coating resin present in the vicinity of the surface of the magnetic carrier. The resin index can be used to evaluate an outermost surface strength of the magnetic carrier, an adhesion property of the core particles to the coating resin when forming the resin coating layer on the surface of the respective core particles, etc.

When the heat treatment of the spherical composite particles is conducted under a high degree of reduced pressure, i.e., under a pressure of less than 40 kPa, the coating amount of the resin on the surface of the respective spherical composite particles tends to be largely reduced or the resin coating layer formed thereon tends to be excessively thinned, so that there tend to occur the defects such as insufficient or uneven electric charge amount and electric resistance value of the magnetic carrier, and the electric resistance value tends to have a high dependency on voltage applied, so that the resulting images generally tend to be inferior to gradation and therefore become undesirable. In addition, the resulting magnetic carrier tends to be insufficient in outermost surface strength thereof. Further, if defects such as peeling of the resin coating layer, etc., are caused when used for a long period of time, there tends to occur undesirable carrier adhesion owing to leakage phenomenon. In addition, when further coating the surface of the respective particles with the resin, the adhesion property of the particles to the resin tends to be deteriorated, so that the uniform resin coating layer tends to be hardly formed. Also, if defects such as peeling of the coating layer, etc., are caused when used for a long period of time, there tends to occur undesirable carrier adhesion owing to leakage phenomenon. On the other hand, when the heat treatment of the spherical composite particles is conducted under a low degree of reduced pressure, i.e., under pressure of more than 80 kPa, the coating amount of the resin on the surface of the respective spherical composite particles tends to be excessively increased or the thickness of the resin coating layer formed thereon tends to be excessively thickened, so that the electric charge amount or electric resistance value of the resulting magnetic carrier tends to be excessively increased. In addition, when further coating the surface of the respective particles with the resin, it is not possible to attain a suitable anchor effect thereon, so that there tend to occur the problems such as deterioration in strength of the magnetic carrier. Therefore, the heat treatment of the spherical composite particles is preferably conducted under a degree of the reduced pressure of 40 to 80 kPa, and more preferably under a degree of the reduced pressure of 45 to 75 kPa.

When the heat treatment of the spherical composite particles is conducted at a heat-treating temperature of higher than 250° C., the coating amount of the resin on the surface of the respective spherical composite particles tends to be largely reduced or the resin coating layer formed thereon tends to be excessively thinned, so that there tend to occur the defects such as insufficient or uneven electric charge amount and electric resistance value of the magnetic carrier, and the electric resistance value tends to have a high dependency on voltage applied, so that the resulting images generally tend to have no gradation and therefore become undesirable. In addition, the resulting magnetic carrier tends to be insufficient in outermost surface strength thereof. Further, if defects such as peeling of the resin coating layer, etc., are caused when used for a long period of time, there tends to occur undesirable carrier adhesion owing to leakage phenomenon. In addition, when further coating the surface of the respective particles with the resin, the adhesion property of the particles to the resin tends to be deteriorated, so that the uniform resin coating layer tends to be hardly formed. Also, if defects such as peeling of the coating layer, etc., are caused when used for a long period of time, there tends to occur undesirable carrier adhesion owing to leakage phenomenon. On the other hand, when the heat treatment of the spherical composite particles is conducted at a heat-treating temperature of lower than 150° C., the coating amount of the resin on the surface of the respective spherical composite particles tends to be excessively increased or the thickness of the resin coating layer formed thereon tends to be excessively thickened, so that the electric charge amount or electric resistance value of the resulting magnetic carrier tends to be excessively increased. In addition, when further coating the surface of the respective particles with the resin, it is not possible to attain a suitable anchor effect thereon, so that there tend to occur the problems such as deterioration in strength of the magnetic carrier. Therefore, the heat treatment of the spherical composite particles is preferably conducted at a heat-treating temperature of 150 to 250° C., and more preferably at a heat-treating temperature of 170 to 230° C.

When the heat treatment of the spherical composite particles is conducted for a heat-treating time of more than 7 hr, the coating amount of the resin on the surface of the respective spherical composite particles tends to be largely reduced or the resin coating layer formed thereon tends to be excessively thinned, so that there tend to occur the defects such as insufficient or uneven electric charge amount and electric resistance value of the magnetic carrier, and the electric resistance value tends to have a high dependency on voltage applied, so that the resulting images generally tend to have no gradation and therefore become undesirable. In addition, the resulting magnetic carrier tends to be insufficient in outermost surface strength thereof. Further, if defects such as peeling of the resin coating layer, etc., are caused when used for a long period of time, there tends to occur undesirable carrier adhesion owing to leakage phenomenon. In addition, when further coating the surface of the respective particles with the resin, the adhesion property of the particles to the resin tends to be deteriorated, so that the uniform resin coating layer tends to be hardly formed. Also, if defects such as peeling of the coating layer, etc., are caused when used for a long period of time, there tends to occur undesirable carrier adhesion owing to leakage phenomenon. On the other hand, when the heat treatment of the spherical composite particles is conducted for a heat-treating time of less than 1 hr, the coating amount of the resin on the surface of the respective spherical composite particles tends to be excessively increased or the thickness of the resin coating layer formed thereon tends to be excessively thickened, so that the electric charge amount or electric resistance value of the resulting magnetic carrier tends to be excessively increased. In addition, when further coating the surface of the respective particles with the resin, it is not possible to attain a suitable anchor effect thereon, so that there tend to occur the problems such as deterioration in strength of the magnetic carrier. Therefore, the heat treatment of the spherical composite particles is preferably conducted for a heat-treating time of 1 to 7 hr, and more preferably for a heat-treating time of 2 to 6 hr.

Meanwhile, in order to provide the inert atmosphere, there is preferably used an inert gas. Examples of the inert gas include nitrogen, helium, argon, a carbon dioxide gas, etc. From the industrial viewpoints, it is costly advantageous that the heat treatment is conducted while blowing a nitrogen gas into the reaction system, thereby obtaining the magnetic carrier having stable characteristics.

Since the melamine resin has a positive charging property, the magnetic carrier can be enhanced in a positive charging property by using the melamine resin therein.

Also, since the melamine resin is capable of forming a hard film, the magnetic carrier can be enhanced in durability by using the melamine resin therein.

In the magnetic carrier according to the present invention, the surface of the respective composite particles may be coated with the resin.

The coating resins used in the present invention are not particularly limited. Examples of the coating resins include polyolefin-based resins such as polyethylene and polypropylene; polystyrene; acrylic resins; polyacrylonitrile; polyvinyl-based or polyvinylidene-based resins such as polyvinyl acetate, polyvinyl alcohol, polyvinyl butyral, polyvinyl chloride, polyvinyl carbazole, polyvinyl ether and polyvinyl ketone; vinyl chloride/vinyl acetate copolymers and styrene/acrylic acid copolymers; straight silicone-based resins having an organosiloxane bond and modified products thereof; fluorine-based resins such as polytetrafluoroethylene, polyvinyl fluoride, polyvinylidene fluoride and polychlorotrifluoroethylene; polyesters; polyurethanes; polycarbonates; amino-based resins such as urea/formaldehyde resins; epoxy-based resins; polyamide resins; polyimide resins; polyamide imide resins; fluorine-containing polyamide resins; fluorine-containing polyimide resins; and fluorine-containing polyamide imide resins.

In the magnetic carrier according to the Invention 5, the surface of the respective composite particles is preferably coated with at least one resin selected from the group consisting of silicone-based resins, acrylic resins and styrene-acrylic resins. When coating the surface of the respective composite particles with the silicone-based resins that have a low surface energy, it is possible to suppress occurrence of spent toner. In addition, when coated with the acrylic resins or the styrene-acrylic resins, the effects of enhancing adhesion to the core particles and a charging property of the resulting magnetic carrier can be attained.

As the silicone resin, there may be used conventionally known silicone resins. Specific examples of the silicone resins include straight silicone resins having an organosiloxane bond only, and modified silicone resins obtained by modifying the straight silicone resins with an alkyd resin, a polyester, an epoxy resin, a urethane resin or the like.

Examples of the acrylic resins include copolymers obtained by copolymerizing an alkyl acrylate such as methyl methacrylate, methyl ethacrylate, ethyl methacrylate, butyl methacrylate, lauryl methacrylate, stearyl methacrylate and behenyl methacrylate, a cycloalkyl acrylate such as cyclopentyl methacrylate and cyclohexyl methacrylate or an aromatic acrylate such as phenyl acrylate, with acrylic acid, copolymers obtained by copolymerizing the above acrylates with an epoxy compound such as glycidyl methacrylate, and copolymers obtained by copolymerizing the above acrylates with an alcohol-based compound such as glycerol monomethacrylate and 2-hydroxyethyl methacrylate. In view of a less environmental dependency or the like of the resulting magnetic carrier, among these acrylic resins, preferred are those produced using short-chain alkyl acrylates such as methyl methacrylate and ethyl ethacrylate.

Examples of the styrene-acrylic resins include copolymers of the above acrylic monomer with a styrene-based monomer. Especially preferred styrene-acrylic resins are copolymers of styrene with short-chain alkyl methacrylates because the copolymers have a less difference between a electric charge amount under high-temperature and high-humidity conditions and a electric charge amount under low-temperature and low-humidity conditions.

The coating amount of the resin on the magnetic carrier of the present invention is preferably 0.1 to 5.0% by weight based on the weight of the composite particles. When the coating amount of the resin is less than 0.1% by weight, it may be difficult to sufficiently coat the particles with the resin, resulting in unevenness of the obtained resin coat. When the coating amount of the resin is more than 5.0% by weight, although the resin coat can be adhered onto the surface of the respective composite particles, the thus produced composite particles tend to be agglomerated together, so that it may be difficult to well control the particle size of the composite particles. The coating amount of the resin on the magnetic carrier is more preferably 0.3 to 3.0% by weight.

In the present invention, the resin coating layer may also contain fine particles. Examples of the suitable fine particles include those fine particles capable of imparting a negative charging property to a toner such as fine particles of quaternary ammonium salt-based compounds, triphenylmethane-based compounds, imidazole-based compounds, nigrosine-based dyes, polyamine resins, etc., as well as those fine particles capable of imparting a positive charging property to a toner such as fine particles of dyes comprising metals such as Cr and Co, salicylic acid metal salt compounds, alkyl salicylic acid metal salt compounds, etc. Meanwhile, these fine particles may be used alone or in combination of any two or more thereof.

Also, in the present invention, the resin coating layer may also contain conductive fine particles. It is advantageous to incorporate the conductive fine particles into the resin, because the resulting magnetic carrier can be readily controlled in resistance thereof. As the conductive fine particles, there may be used conventionally known conductive fine particles. Examples of the conductive fine particles include fine particles of carbon blacks such as acetylene black, channel black, furnace black and ketjen black; carbides of metals such as Si and Ti; nitrides of metals such as B and Ti; and borates of metals such as Mo and Cr. These conductive fine particles may be used alone or in combination of any two or more thereof. Among these conductive fine particles, preferred are fine particles of carbon blacks.

When coating the surface of the respective composite particles with the resin, there may be used the method in which the resin is blown on the spherical composite particles using a known spray dryer, the method in which the spherical composite particles are dry-mixed with the resin using a Henschel mixer, a high-speed mixer, etc., or the method in which the spherical composite particles are immersed in a resin-containing solvent.

Next, the two-component system developer of the present invention is described.

As the toner used in combination with the magnetic carrier according to the present invention, there may be mentioned known toners. More specifically, there may be used those toners comprising a binder resin and a colorant as main components together with a release agent, a fluidizing agent, etc., which may be added to the main components, if required. Also, the toners may be produced by known methods.

<Functions>

The important point of the present invention resides in that the magnetic carrier for an electrophotographic developer comprises spherical composite core particles comprising at least ferromagnetic iron oxide fine particles and a cured phenol resin, and having an average particle diameter of 20 to 60 μm, the magnetic carrier for an electrophotographic developer satisfying the following formula (1)

$$\sigma_1-\sigma_0=-2 \text{ to } 0 \quad (1)$$

wherein $\sigma_0$ represents a saturation magnetization ($Am^2/kg$) of the carrier particles having a particle diameter in the vicinity of the average particle diameter of the magnetic carrier for an electrophotographic developer; and $\sigma_1$ represents a saturation magnetization ($Am^2/kg$) of the carrier particles having a particle diameter of less than 20 μm.

In the present invention, by reducing dispersion in magnetization value of the magnetic carrier, it is possible to obtain the magnetic carrier that can exhibit a good durability, is free from occurrence of carrier adhesion, and maintain a high quality of images produced for a long period of time.

In the Invention 2, by reducing dispersion in magnetization value of the magnetic carrier and well controlling a coating rate of the melamine resin coating layer formed on a surface of the respective spherical composite core particles, it is possible to attain desired electric charge amount and electric resistance value of the magnetic carrier and a desired outermost surface strength of the magnetic carrier, and it is therefore possible to obtain the magnetic carrier that can exhibit a good durability, is free from occurrence of carrier adhesion, and maintain a high quality of images produced for a long period of time.

Since the resin-coated magnetic carrier according to the Invention 5 reduces dispersion in magnetization value of the magnetic carrier, it is possible to obtain the magnetic carrier that can exhibit a good durability, is free from occurrence of carrier adhesion, and maintain a high quality of images produced for a long period of time.

The two-component system developer according to the Invention 6 is capable of exhibiting a good durability, suppressing occurrence of carrier adhesion and maintaining a high quality of images produced for a long period of time. In particular, in a high-voltage range where an electric resistance of a core material tends to be considerably influenced, it is possible to suppress the occurrence of brush marks on a solid image portion owing to leakage phenomenon of electric charges and images defects such as being inferior to gradation characteristics. Further, it is possible to prevent the magnetic carrier from deterioration with time owing to abrasion or peeling-off of the coating resin therefrom when used for a long period of time.

EXAMPLES

The present invention is described in more detail by the following typical Examples.

The average particle diameter of the particles was expressed by the volume-based average value as measured using a laser diffraction particle size distribution meter "LA500" manufactured by Horiba Seisakusho Co., Ltd. Also, the shape of the particles was determined by observing particles using a scanning electron microscope "S-4800" manufactured by Hitachi Ltd.

The saturation magnetization values $\sigma_0$, $\sigma_1$ and $\sigma_2$ were determined as follows.

That is, in the case where the carrier particles had an average particle diameter of 20 to 30 μm, the carrier particles were classified by test sieves having mesh sizes of 20 μm and 38 μm, respectively; in the case where the carrier particles had an average particle diameter of 30 to 40 μm, the carrier particles were classified by test sieves having mesh sizes of 25 μm and 45 μm, respectively; in the case where the carrier particles had an average particle diameter of 40 to 50 μm, the carrier particles were classified by test sieves having mesh sizes of 32 μm and 53 μm, respectively; and in the case where the carrier particles had an average particle diameter of 50 to 60 μm, the carrier particles were classified by test sieves having mesh sizes of 45 μm and 63 μm, respectively. The resulting respective particles were regarded as the carrier particles having a particle diameter in the vicinity of an average particle diameter thereof, and a saturation magnetization of the particles as measured by applying an external magnetic field of 795.8 kA/m thereto was expressed by $\sigma_0$.

In addition, the carrier particles were classified by a test sieve having a mesh size of 20 μm, and the obtained undersize particles were regarded as particles having a particle diameter of not more than 20 μm, and a saturation magnetization thereof as measured under application of an external magnetic field of 795.8 kA/m was expressed by $\sigma_1$. Also, the carrier particles were classified by a test sieve having a mesh size of 75 μm, and the obtained oversize particles were regarded as particles having a particle diameter of not less than 75 μm, and a saturation magnetization thereof as measured under application of an external magnetic field of 795.8 kA/m was expressed by $\sigma_2$.

In the present invention, the sieving of the magnetic carrier was performed as follows.

1. Test sieves having respective mesh sizes were fitted to an electromagnetic sieve shaker (Model No. "AS200DIGIT, 60 Hz" manufactured by Retch GmbH). When two kinds of test sieves were fitted, the test sieves were stacked on a receiving pan in the order of a mesh size thereof from a smaller side, the pan with the stacked sieves was set to the sieve shaker. As the test sieves, there were used "Test Sieves" (JIS Z 8801; (0200 mm×45 mmH) manufactured by Tokyo Screen Co., Ltd. Among the test sieves having mesh sizes of 20 μm, 25 μm, 32 μm, 38 μm, 45 μm, 53 μm, 63 μm and 75 μm, as the test sieves having mesh sizes of 20 μm, 25 μm, 32 μm and 38 μm, there were used twill weave screens.

2. Thirty grams of the magnetic carrier was charged into the uppermost sieve, and continuously vibrated by setting a timer to 5 min and controlling an amplitude knob to attain an amplitude of 1.5 mm.

3. The 20 μm-sieve undersize carrier particles were sampled as the magnetic carrier for measurement of $\sigma_1$, and the 75 μm-sieve oversize carrier particles were sampled as the magnetic carrier for measurement of $\sigma_2$. As the magnetic carrier for measurement of $\sigma_0$, the oversize carrier particles remaining on the lower sieve among the two kinds of sieves set were sampled. The respective magnetic carrier particles thus sieved and sampled were used as a sample for measurement of a saturation magnetization thereof. If the carrier particles were not sampled in an amount sufficient for the measurement of a saturation magnetization thereof in only one sieving operation, the sieving operation was repeated several times to sample a necessary amount of the carrier particles for the measurement.

The saturation magnetization and residual magnetization were expressed by the values measured using a vibration sample-type magnetometer "VSM-3S-15" manufactured by Toei Kogyo Co., Ltd., by applying an external magnetic field of 795.8 kA/m (10 kOe) thereto.

The resin indices $C_1$ and $C_2$ were evaluated by using the following apparatus and conditions. Using a scanning electron microscope "S-4800" manufactured by Hitachi Ltd., backscattered electron images of 10 or more spherical composite particles were observed at an acceleration voltage of 1 kV or 2 kV at a magnification of 15000 times. The thus obtained backscattered electron image was binarized using an image analysis software to distinguish the occupied area of the ferromagnetic iron oxide fine particles from the other area by contrast thereof. The area other than the occupied area of the ferromagnetic iron oxide fine particles was regarded as the occupied area of the resin. The ratio of an area of the resin portion relative to a whole area of the backscattered electron image of the composite core particles or the composite particles was calculated from the following formula and defined a resin index (%). At this time, the resin index as measured at an accelerated voltage of 1 kV was expressed by $C_1$, whereas the resin index as measured at an accelerated voltage of 2 kV was expressed by $C_2$. Meanwhile, as the image analysis software, there can be used an ordinary software. In the present invention, there was used "Image Analysis Software A-Zo-Kun" produced by Asahi Kasei Engineering Corp.

Resin index $C$ (%)=100−(the occupied area of the ferromagnetic iron oxide fine particles/whole area of a backscattered electron image of composite core particles or composite particles×100)

The principle of the method for distinguishing the ferromagnetic iron oxide fine particles and the other components on the surface of the respective spherical composite particles is described below. First, by analyzing not secondary electrons generally used for observing a shape but backscattered electrons in a scanning electron microscope, it is possible to detect images owing to the difference in contrast between the ferromagnetic iron oxide fine particles and the other components by the atomic number effect of the backscattered electrons. The atomic number effect means such an effect that as the atomic number of a sample to be detected gets larger, the amount of backscattered electrons discharged therefrom become bigger, so that the sample is detected as a white contrast portion. As a result, the occupied area of the ferromagnetic iron oxide fine particles is observed as a white contrast portion, whereas the other area is observed as a black contrast portion. Further, by adjusting the accelerated voltage to 1 kV, the depth of analysis of electron beams is rendered shallow so that it is possible to more accurately analyze the amount of the resin in the vicinity of the surface of the respective composite particles. Further, depth of analysis of electron beams becomes deeper by adjusting the accelerated voltage to 2 kV, so that it is possible to attain information concerning a thickness of the resin-coating layer on the surface of the respective particles.

The electric resistance value (volume resistivity) of the particles was expressed by the value as measured using a "High Resistance Meter 43398" manufactured by Yokogawa Hewlett Packard Co., Ltd.

The compressed density CD of the ferromagnetic iron oxide fine particles was measured as follows.

The sample (25 g) was weighed and charged into a 25 mmφ cylindrical mold, and held in a uniformly filled state therein. After pressing the sample by applying a given pressure (1 t/cm$^2$) thereto, the height of the sample in the mold was measured to determine a volume V of the sample after pressed and calculate a compressed density CD thereof from the following formula:

$$CD=W/V$$

wherein CD: compressed density (g/cm$^3$); W: a weight (g) of the sample; V: a volume (cm$^3$) of the sample after pressed.

The shape factors SF1 and SF2 of the magnetic carrier were measured according to the following procedure.

The shape factors SF1 and SF2 as used herein are defined as follows. That is, for example, from a micrograph obtained using a scanning electron microscope "S-4800" manufactured by Hitachi Ltd., images of 100 carrier particles as enlarged images (magnification: ×300 times) were sampled randomly, and these image data were introduced through an interface, for example, into an image analyzer "Luzex AP" manufactured by Nireco Corp., and analyzed therein. The shape factors SF1 and SF2 were defined as the values calculated according to the following formulae.

SF1=(absolute maximum length of particle)$^2$/(projected area of particle)×(π/4)×100

SF2=(peripheral length of particle)$^2$/(projected area of particle)×(¼π)×100

The shape factor SF1 represents a degree of roundness of particles, whereas the shape factor SF2 represents a degree of unevenness on a surface of particles. Therefore, when the particle shape is deviated from a circle (sphere), the shape factor SF1 is increased, whereas when the degree of unevenness on the surface of the particles becomes large, the shape factor SF2 is also increased. The respective shape factors become close to 100 as the particle shape approaches a complete round (sphere).

The bulk density was measured by the method described in JIS K5101.

The true specific gravity was expressed by the value as measured using a multi-volume density meter "1305 Model" manufactured by Mictromeritics/Shimadzu Seisakusho Corp.

The water content was measured by the following Karl Fischer coulometric titration method using a trace water content analyzer "AQ-2100" manufactured by Hiranuma Sangyo Co., Ltd. That is, 1 g of a sample whose moisture content was controlled by allowing the sample to stand under the environmental conditions of 24° C. and 60% RH for 24 hr or longer, was accurately weighed in a glass sampling tube, and then the sampling tube was lidded with an aluminum foil (at this time, an empty sampling tube lidded with the same aluminum foil was prepared in order to calibrate a water content in air).

Under the conditions including a heating temperature of 150° C. and a flow rate of a carrier gas (nitrogen gas) of 100 mL/min, water supplied from a water vaporization device "EV-2010" manufactured by Hiranuma Sangyo Co., Ltd., which was connected to the trace water content analyzer "AQ-2100", was subjected to titration under the conditions of INTERVAL=30 min and TIMER=1 min. In the measurement, "HYDRANAL AQUALYTE RS" produced by Riedel de Haeen AG was used as a generating solution, and "AQUALYTE CN" produced by Kanto Kagaku Co., Ltd., was used as a counter electrode solution.

The electric charge amount of the toner was determined as follows. That is, 95 parts by weight of the magnetic carrier were fully mixed with 5 parts by weight of a toner produced by the following method, and the amount of electric charge generated on the toner was measured using a blow-off charge amount measuring device "TB-200" manufactured by Toshiba Chemical Corp.

(Toner Production Example)

| | |
|---|---|
| Polyester resin | 100 parts by weight |
| Copper phthalocyanine-based colorant | 5 parts by weight |
| Charge controlling agent (zinc di-tert-butyl salicylate compound) | 3 parts by weight |
| Wax | 9 parts by weight |

The above materials were fully premixed with each other using a Henschel mixer, and the resulting mixture was melted and kneaded in a twin-screw extrusion-type kneader. After being cooled, the kneaded material was pulverized using a hammer mill and then classified to obtain negatively charging blue particles having a weight-average particle diameter of 7.4 μm.

One hundred parts by weight of the above negatively charging blue particles were mixed with 1 part by weight of a hydrophobic silica using a Henschel mixer to obtain a negatively charging cyan toner (a).

[Forced Deterioration Test of Magnetic Carrier]

Fifty grams of the magnetic carrier was charged into a 100-cc glass sampling bottle. After the bottle was plugged, the contents of the bottle were shaken using a paint conditioner manufactured by Red Devil Inc., for 24 hr. The electric charge amount and electric resistance values of the respective samples before and after being shaken were measured, and further the surface of the respective sample particles was observed using a scanning electron microscope "S-4800" manufactured by Hitachi Ltd., to confirm whether or not any peeling-off or the like occurred thereon.

The change in electric charge amount between before and after the forced deterioration test was expressed by percentage (%) of variation in electric charge amount of the respective samples between before and after the shaking operation at normal temperature and normal humidity (24° C. and 60% RH) as shown by the following formula, and the results were evaluated according to the following ratings. The developer was prepared by fully mixing 95 parts by weight of the magnetic carrier of the present invention and 5 parts by weight of the negatively charging cyan toner (a).

$$\text{Rate of change in electric charge amount (\%)}=(1-Q/Q_{INI})\times 100$$

wherein $Q_{INI}$ is an electric charge amount before the forced deterioration test; and Q is an electric charge amount after the forced deterioration test.

A: Rate of change in electric charge amount between before and after the forced deterioration test was not less than 0% and less than 5%;

B: Rate of change in electric charge amount between before and after the forced deterioration test was not less than 5% and less than 10%;

C: Rate of change in electric charge amount between before and after the forced deterioration test was not less than 10% and less than 20%;

D: Rate of change in electric charge amount between before and after the forced deterioration test was not less than 20% and less than 30%; and E: Rate of change in electric charge amount between before and after the forced deterioration test was not less than 30%.

The electric resistance value was evaluated by the rate of change (%) in electric resistance of the respective samples between before and after the shaking operation as measured at normal temperature and normal humidity (24° C. and 60% RH) which was represented by the following formula, and the results were evaluated according to the following ratings.

$$\text{Rate of change in electric resistance value}=\text{Log}(R_{INI}/R)$$

wherein $R_{INI}$ is an electric resistance value before the forced deterioration test as measured by applying a voltage of 100 V to the sample; and R is an electric resistance value after the forced deterioration test as measured by applying a voltage of 100 V to the sample.

A: Rate of change in electric resistance value between before and after the forced deterioration test was not less than −0.5 and less than 0;

B: Rate of change in electric resistance value between before and after the forced deterioration test was not less than 0 and less than 0.5;

C: Rate of change in electric resistance value between before and after the forced deterioration test was not less than 0.5 and less than 1;

D: Rate of change in electric resistance value between before and after the forced deterioration test was not less than 1 and less than 1.5; and E: Rate of change in electric resistance value between before and after the forced deterioration test was not less than 1.5.

The peeling or abrasion, etc., of the coating resin layer on the surface of the respective particles or the like was evaluated using a scanning electron microscope ("S-4800" manufactured by Hitachi Ltd.) according to the following three ratings. The Rank A or B was recognized as being in an acceptable level without any significant problem.

A: None of peeling or abrasion, etc., of the coating layer occurred.

B: Slight peeling or abrasion, etc., of the coating layer occurred.

C: Extremely severe peeling or abrasion, etc., of the coating layer occurred.

[Evaluation of Resin-Coated Carrier Based on Machine Evaluation]

The developer was prepared by fully mixing 95 parts by weight of the magnetic carrier according to the present invention with 5 parts by weight of the negatively charging cyan toner (a). The thus obtained developer was subjected to the following machine evaluation using a modified copying machine from "LP8000C" manufactured by Epson Corp. That is, the developer was subjected to the machine evaluation using an original copy having an image ratio of 10% while varying a bias voltage applied thereto under normal temperature/normal humidity conditions of 24° C. and 60% RH.

After outputting 1000 copies (initial stage) for a durability test of images based on the above machine evaluation, an adhesive tape was closely attached onto a photoreceptor of the copying machine to sample the developer deposited thereonto, and then observed by an optical microscope to count the number of the magnetic carrier particles deposited on an area of 1 cm×1 cm on the photoreceptor and calculate the number of the magnetic carrier particles deposited per 1 $cm^2$. The carrier adhesion was evaluated according to the following evaluation ratings.

A: Less than 3 particles: very good.

B: Not less than 3 but less than 5 particles: good.

C: Not less than 5 but less than 10 particles: practically acceptable level.

D: Not less than 10 particles: unacceptable level.

[Production of Ferromagnetic Iron Oxide Fine Particles: Ferromagnetic Iron Oxide Fine Particles 1]

The slurry solution containing ferromagnetic iron oxide fine particles having a spherical shape and an average particle diameter of 0.24 μm which had been produced by conventionally known methods was subjected to decantation and then to wet pulverization using a ball mill, and thereafter the resulting particles were subjected to drying using a flash dryer, thereby obtaining spherical ferromagnetic iron oxide fine particles.

Next, 1000 g of the thus obtained spherical ferromagnetic iron oxide fine particles were charged into a flask and fully stirred therein. Then, 7.0 g of an epoxy group-containing silane-based coupling agent ("KBM-403" (tradename) produced by Shin-Etsu Chemical Co., Ltd.) was added in the flask, and the resulting mixture was heated to about 100° C. and sufficiently stirred and mixed for 30 min, thereby obtaining spherical ferromagnetic iron oxide fine particles 1 coated with the coupling agent.

The thus obtained ferromagnetic iron oxide fine particles 1 had a saturation magnetization value of 86.0 $Am^2/kg$ and a compressed density of 2.5 $g/cm^3$.

Ferromagnetic Iron Oxide Fine Particles 2:

Spherical ferromagnetic iron oxide fine particles 2 were produced under the same conditions as used in production of the above ferromagnetic iron oxide fine particles 1 except that a slurry solution containing ferromagnetic iron oxide fine particles having a spherical shape and an average particle diameter of 0.16 μm which had been produced by conventionally known methods was treated using a filter thickener to remove a soluble salt therefrom.

The production conditions and various properties of the thus obtained ferromagnetic iron oxide fine particles 2 are shown in Table 1.

Ferromagnetic Iron Oxide Fine Particles 3:

Spherical ferromagnetic iron oxide fine particles 3 were produced under the same conditions as used in production of the above ferromagnetic iron oxide fine particles 1 except that a slurry solution containing ferromagnetic iron oxide fine particles having a spherical shape and an average particle diameter of 0.35 μm which had been produced by conventionally known methods was dried using a freeze dryer.

The production conditions and various properties of the thus obtained ferromagnetic iron oxide fine particles 3 are shown in Table 1.

Ferromagnetic Iron Oxide Fine Particles 4:

Spherical ferromagnetic iron oxide fine particles 4 were produced under the same conditions as used in production of the above ferromagnetic iron oxide fine particles 1 except that a slurry solution containing ferromagnetic iron oxide fine particles having a spherical shape and an average particle diameter of 0.52 μm which had been produced by conventionally known methods was dried using a vacuum dryer.

The production conditions and various properties of the thus obtained ferromagnetic iron oxide fine particles 4 are shown in Table 1.

Ferromagnetic Iron Oxide Fine Particles 5:

Spherical ferromagnetic iron oxide fine particles 5 were produced under the same conditions as used in production of the above ferromagnetic iron oxide fine particles 1 except that a slurry solution containing ferromagnetic iron oxide fine particles having a spherical shape and an average particle diameter of 0.23 μm which had been produced by conventionally known methods was dried using a flash dryer without subjected to wet pulverization.

The production conditions and various properties of the thus obtained ferromagnetic iron oxide fine particles 5 are shown in Table 1.

Ferromagnetic Iron Oxide Fine Particles 6:

Spherical ferromagnetic iron oxide fine particles 6 were produced under the same conditions as used in production of the above ferromagnetic iron oxide fine particles 1 except that a slurry solution containing ferromagnetic iron oxide fine particles having a spherical shape and an average particle diameter of 0.50 μm which had been produced by conventionally known methods was treated using a press filter, subjected to wet pulverization using a ball mill, and then subjected to filtration and washing with water to obtain a paste, and the thus obtained paste was dried.

The production conditions and various properties of the thus obtained ferromagnetic iron oxide fine particles 6 are shown in Table 1.

Ferromagnetic Iron Oxide Fine Particles 7:

Spherical ferromagnetic iron oxide fine particles 7 were produced under the same conditions as used in production of the above ferromagnetic iron oxide fine particles 2 except that a slurry solution containing ferromagnetic iron oxide fine particles having a spherical shape and an average particle diameter of 1.03 μm which had been produced by conventionally known methods was used.

The production conditions and various properties of the thus obtained ferromagnetic iron oxide fine particles 7 are shown in Table 1.

Ferromagnetic Iron Oxide Fine Particles 8:

A flask was charged with 70 parts by weight of the above obtained ferromagnetic iron oxide fine particles 3 and 30 parts by weight of the above obtained ferromagnetic iron oxide fine particles 7, and the contents of the flask were sufficiently stirred and mixed with each other at a stirring speed of 250 rpm for 30 min, thereby obtaining spherical ferromagnetic iron oxide fine particles 8.

The thus obtained ferromagnetic iron oxide fine particles 8 had a saturation magnetization value of 85.8 $Am^2/kg$ and a compressed density of 2.9 $g/cm^3$.

TABLE 1

| | Production conditions of ferromagnetic iron oxide fine particles | | |
|---|---|---|---|
| | Washing | Wet pulverization | Drying |
| Ferromagnetic iron oxide fine particles 1 | Decantation | Ball mill | Flash drying |
| Ferromagnetic iron oxide fine particles 2 | Filter thickener | Ball mill | Flash drying |
| Ferromagnetic iron oxide fine particles 3 | Decantation | Ball mill | Freeze drying |
| Ferromagnetic iron oxide fine particles 4 | Decantation | Ball mill | Vacuum drying |
| Ferromagnetic iron oxide fine particles 5 | Decantation | — | Flash drying |
| Ferromagnetic iron oxide fine particles 6 | Press filter | Ball mill | drying |
| Ferromagnetic iron oxide fine particles 7 | Filter thickener | Ball mill | Flash drying |

| | Properties of ferromagnetic iron oxide fine particles | | |
|---|---|---|---|
| | Average particle diameter (μm) | Shape | Saturation magnetization ($Am^2/kg$) |
| Ferromagnetic iron oxide fine particles 1 | 0.24 | Spherical | 86.0 |
| Ferromagnetic iron oxide fine particles 2 | 0.16 | Spherical | 84.2 |
| Ferromagnetic iron oxide fine particles 3 | 0.35 | Spherical | 83.2 |
| Ferromagnetic iron oxide fine particles 4 | 0.52 | Spherical | 85.7 |
| Ferromagnetic iron oxide fine particles 5 | 0.23 | Spherical | 85.0 |

TABLE 1-continued

| | | | |
|---|---|---|---|
| Ferromagnetic iron oxide fine particles 6 | 0.50 | Spherical | 85.3 |
| Ferromagnetic iron oxide fine particles 7 | 1.03 | Spherical | 86.0 |

Example 1

Production of Spherical Composite Core Particles

| | |
|---|---|
| Phenol | 11 parts by weight |
| 37% Formalin | 14 parts by weight |
| Ferromagnetic iron oxide fine particles 1 | 100 parts by weight |
| 25% Aqueous ammonia | 5 parts by weight |
| Water | 19 parts by weight |

The above materials were charged into a flask, and heated to 85° C. over 60 min while stirring at a stirring speed of 250 rpm, and then the contents of the flask were reacted and cured at the same temperature for 120 min, thereby producing composite core particles comprising the ferromagnetic iron oxide fine particles and the binder resin.

Next, the contents of the flask were cooled to 30° C., and then a supernatant liquid was removed therefrom. Further, the resulting precipitate as a lower layer was washed with water and then air-dried. Next, the dried precipitate was subjected to heat treatment in a nitrogen gas atmosphere at a temperature of 210° C. under a degree of the reduced pressure of 60 kPa for 4 hr, thereby obtaining spherical composite core particles 1.

As a result, it was confirmed that the resulting spherical composite core particles 1 had an average particle diameter of 54 μm; a bulk density of 1.82 g/cm$^3$; a specific gravity of 3.56 g/cm$^3$; a saturation magnetization value of 74.0 Am$^2$/kg; $\sigma_1-\sigma_0$: −1.1; $\sigma_2-\sigma_0$: −1.2; and a resin index $C_1$ of 57%.

Examples 2 to 6 and Comparative Examples 1 to 3

The procedure was conducted under the same conditions as in production of the spherical composite core particles 1 except that the production conditions of the spherical composite core particles were changed variously, thereby obtaining spherical composite core particles 2 to 9. Various specification items of the thus obtained spherical composite core particles are shown in Table 2.

Various properties of the thus obtained spherical composite core particles 2 to 9 are shown in Table 3.

TABLE 2

| Examples and Comparative Examples | Production conditions of composite core particles | | | |
|---|---|---|---|---|
| | Composite core particles | Ferromagnetic iron oxide fine particles | | |
| | | Kind | Compressed density (g/m$^3$) | Weight part(s) |
| Example 1 | 1 | 1 | 2.5 | 100 |
| Example 2 | 2 | 2 | 2.6 | 100 |
| Example 3 | 3 | 3 | 2.4 | 100 |
| Example 4 | 4 | 4 | 2.3 | 100 |
| Example 5 | 5 | 3 | 2.4 | 100 |
| Example 6 | 6 | 7 | 2.9 | 100 |
| Comparative Example 1 | 7 | 5 | 2.2 | 100 |
| Comparative Example 2 | 8 | 6 | 2.0 | 100 |
| Comparative Example 3 | 9 | 5 | 2.2 | 100 |

| Examples and Comparative Examples | Production conditions of composite core particles | | |
|---|---|---|---|
| | Phenol | Aldehyde compound | |
| | Weight part(s) | Kind | Weight part(s) |
| Example 1 | 11 | 37% Formalin | 14 |
| Example 2 | 13 | 37% Formalin | 15 |
| Example 3 | 12 | 37% Formalin | 14 |
| Example 4 | 14 | 37% Formalin | 16 |
| Example 5 | 12 | 37% Formalin | 14 |
| Example 6 | 11 | 37% Formalin | 15 |
| Comparative Example 1 | 13 | 37% Formalin | 14 |
| Comparative Example 2 | 12 | 37% Formalin | 16 |
| Comparative Example 3 | 13 | 37% Formalin | 14 |

| Examples and Comparative Examples | Production conditions of composite core particles | | |
|---|---|---|---|
| | Basic catalyst | | Water |
| | Kind | Weight part(s) | Weight part(s) |
| Example 1 | 25% Aqueous ammonia | 5 | 19 |
| Example 2 | 25% Aqueous ammonia | 6 | 17 |
| Example 3 | 25% Aqueous ammonia | 4 | 16 |
| Example 4 | 25% Aqueous ammonia | 5 | 18 |
| Example 5 | 25% Aqueous ammonia | 4 | 16 |
| Example 6 | 25% Aqueous ammonia | 5 | 17 |
| Comparative Example 1 | 25% Aqueous ammonia | 5 | 17 |
| Comparative Example 2 | 25% Aqueous ammonia | 6 | 19 |
| Comparative Example 3 | 25% Aqueous ammonia | 5 | 17 |

| Examples and Comparative Examples | Heat treatment | | |
|---|---|---|---|
| | Degree of the reduced pressure (kPa) | Temperature (° C.) | Treating time (hr) |
| Example 1 | 60 | 210 | 4 |
| Example 2 | 50 | 230 | 3 |
| Example 3 | 75 | 250 | 2.5 |
| Example 4 | 78 | 160 | 4 |
| Example 5 | 50 | 150 | 4 |
| Example 6 | 40 | 210 | 3 |
| Comparative Example 1 | 50 | 210 | 4 |
| Comparative Example 2 | 78 | 170 | 4 |
| Comparative Example 3 | 75 | 240 | 3 |

TABLE 3

| Examples and Comparative Examples | Composite core particles | Properties of composite core particles: Average particle diameter (μm) | Bulk density (g/cm³) | Specific gravity (g/cm³) |
|---|---|---|---|---|
| Example 1 | 1 | 54 | 1.82 | 3.56 |
| Example 2 | 2 | 36 | 1.85 | 3.62 |
| Example 3 | 3 | 41 | 1.80 | 3.50 |
| Example 4 | 4 | 32 | 1.84 | 3.60 |
| Example 5 | 5 | 46 | 1.83 | 3.53 |
| Example 6 | 6 | 38 | 1.83 | 3.60 |
| Comparative Example 1 | 7 | 39 | 1.90 | 3.55 |
| Comparative Example 2 | 8 | 27 | 1.89 | 3.57 |
| Comparative Example 3 | 9 | 37 | 1.87 | 3.54 |

| Examples and Comparative Examples | Properties of composite core particles: Saturation magnetization ($Am^2/kg$) | Content of magnetic particles (%) | $\sigma_1$- $\sigma_0$ |
|---|---|---|---|
| Example 1 | 74.0 | 86.2 | −1.1 |
| Example 2 | 72.8 | 86.9 | −0.9 |
| Example 3 | 72.2 | 85.4 | −1.5 |
| Example 4 | 72.5 | 86.7 | −1.6 |
| Example 5 | 73.7 | 85.8 | −1.5 |
| Example 6 | 70.4 | 86.7 | −0.8 |
| Comparative Example 1 | 73.9 | 86.1 | −2.2 |
| Comparative Example 2 | 73.4 | 86.3 | −2.6 |
| Comparative Example 3 | 72.1 | 85.9 | −2.2 |

| Examples and Comparative Examples | Properties of composite core particles: $\sigma_2$- $\sigma_0$ | Resin index $C_1$ (%) | Electric resistance (Ω · cm) |
|---|---|---|---|
| Example 1 | −1.2 | 57 | 6.0E+08 |
| Example 2 | −0.9 | 45 | 2.8E+08 |
| Example 3 | −1.4 | 52 | 8.5E+07 |
| Example 4 | −1.7 | 78 | 3.6E+08 |
| Example 5 | −1.4 | 70 | 3.0E+08 |
| Example 6 | −0.7 | 41 | 9.7E+07 |
| Comparative Example 1 | −2.1 | 50 | 3.5E+08 |
| Comparative Example 2 | −2.7 | 75 | 2.1E+08 |
| Comparative Example 3 | −2.3 | 58 | 1.8E+08 |

Example 7

Production of Spherical Composite Particles

| | |
|---|---|
| Phenol | 13 parts by weight |
| 37% Formalin | 15 parts by weight |
| Ferromagnetic iron oxide fine particles 1 | 100 parts by weight |
| 25% Aqueous ammonia | 4 parts by weight |
| Water | 17 parts by weight |

The above materials were charged into a flask, and heated to 85° C. over 60 min while stirring at a stirring speed of 250 rpm, and then the contents of the flask were reacted and cured at the same temperature for 120 min, thereby producing composite core particles comprising the ferromagnetic iron oxide fine particles and the binder resin.

Separately, an acid catalyst comprising 0.4 part by weight of water and 0.6 part by weight of a 99% glacial acetic acid aqueous solution was prepared.

Separately, an aqueous solution comprising 1.6 parts by weight of water, 0.6 part by weight of a melamine powder and 1.4 parts by weight of 37% formalin was heated to about 60° C. while stirring at a stirring speed of 250 rpm over 60 min, and then further stirred for about 40 min, thereby preparing a transparent methylol melamine solution.

Next, the above acid catalyst and the above transparent methylol melamine solution were added to the reaction solution containing the above produced composite core particles which was held at the reaction temperature of 85° C. while stirring at a stirring speed of 250 rpm, and then the resulting mixture was reacted for 120 min, thereby obtaining spherical composite particles comprising the spherical composite core particles and a melamine resin coating layer formed on the surface of the respective core particles.

Next, the contents of the flask were cooled to 30° C., and then a supernatant liquid was removed therefrom. Further, the resulting precipitate as a lower layer was washed with water and then air-dried. Next, the dried precipitate was subjected to heat treatment in a nitrogen gas atmosphere at a temperature of 230° C. under a degree of the reduced pressure of 65 kPa for 4 hr, thereby obtaining spherical composite particles 1.

As a result, it was confirmed that the resulting spherical composite particles 1 had an average particle diameter of 40 μm; a bulk density of 1.93 g/cm³; a specific gravity of 3.55 g/cm³; a saturation magnetization value of 72.7 $Am^2/kg$; $\sigma_1-\sigma_0$: −1.1; $\sigma_2-\sigma_0$: −1.2; a resin index $C_1$ of 63%; and a ratio of $C_1/C_2$ of 1.27.

The production conditions of the resulting spherical composite particles 1 are shown in Table 4, and various properties of the spherical composite particles 1 as well as the results of a forced deterioration test thereof are shown in Table 5.

As a result, it was confirmed that when subjected to the forced deterioration test, both the rates of change in electric charge amount and electric resistance value of the spherical composite particles 1 were small, and there occurred substantially no peeling-off of the coating layer on the surface of the respective particles.

Examples 8 to 18 and Comparative Examples 4 to 9

The same procedure as in Example 7 was conducted under the same conditions except that the production conditions of the spherical composite particles 1 were changed variously, thereby obtaining spherical composite particles 2 to 18.

The production conditions of the resulting spherical composite particles 2 to 18 are shown in Table 4, and various properties of the spherical composite particles 2 to 18 and the results of a forced deterioration test thereof are shown in Table 5.

TABLE 4

| Examples and Comparative Examples | Composite particles | Production conditions of composite core particles: Ferromagnetic iron oxide fine particles: Kind | Compressed density (g/cm³) | Weight part(s) |
|---|---|---|---|---|
| Example 7 | 1 | 1 | 2.5 | 100 |
| Example 8 | 2 | 2 | 2.6 | 100 |
| Example 9 | 3 | 3 | 2.4 | 100 |

TABLE 4-continued

| | | | | |
|---|---|---|---|---|
| Example 10 | 4 | 1 | 2.5 | 100 |
| Example 11 | 5 | 4 | 2.3 | 100 |
| Example 12 | 6 | 4 | 2.3 | 100 |
| Example 13 | 7 | 4 | 2.3 | 100 |
| Example 14 | 8 | 4 | 2.3 | 100 |
| Comparative Example 4 | 9 | 5 | 2.2 | 100 |
| Comparative Example 5 | 10 | 5 | 2.2 | 100 |
| Comparative Example 6 | 11 | 5 | 2.2 | 100 |
| Comparative Example 7 | 12 | 5 | 2.2 | 100 |
| Example 15 | 13 | 8 | 2.9 | 100 |
| Example 16 | 14 | 8 | 2.9 | 100 |
| Example 17 | 15 | 8 | 2.9 | 100 |
| Example 18 | 16 | 8 | 2.9 | 100 |
| Comparative Example 8 | 17 | 6 | 2.0 | 100 |
| Comparative Example 9 | 18 | 6 | 2.0 | 100 |

| Examples and Comparative Examples | Production conditions of composite core particles | | |
|---|---|---|---|
| | Phenol | Aldehyde compound | |
| | Weight part(s) | Kind | Weight part(s) |
| Example 7 | 13.0 | 37% Formalin | 15.0 |
| Example 8 | 12.0 | 37% Formalin | 15.0 |
| Example 9 | 13.0 | 37% Formalin | 16.0 |
| Example 10 | 13.0 | 37% Formalin | 15.0 |
| Example 11 | 12.0 | 37% Formalin | 16.0 |
| Example 12 | 12.0 | 37% Formalin | 16.0 |
| Example 13 | 12.0 | 37% Formalin | 16.0 |
| Example 14 | 12.0 | 37% Formalin | 16.0 |
| Comparative Example 4 | 14.0 | 37% Formalin | 17.0 |
| Comparative Example 5 | 14.0 | 37% Formalin | 17.0 |
| Comparative Example 6 | 14.0 | 37% Formalin | 17.0 |
| Comparative Example 7 | 14.0 | 37% Formalin | 17.0 |
| Example 15 | 13.0 | 37% Formalin | 15.0 |
| Example 16 | 13.0 | 37% Formalin | 15.0 |
| Example 17 | 13.0 | 37% Formalin | 15.0 |
| Example 18 | 13.0 | 37% Formalin | 15.0 |
| Comparative Example 8 | 12.0 | 37% Formalin | 15.0 |
| Comparative Example 9 | 12.0 | 37% Formalin | 15.0 |

| Examples and Comparative Examples | Production conditions of composite core particles | | |
|---|---|---|---|
| | Basic catalyst | | Water |
| | Kind | Weight part(s) | Weight part(s) |
| Example 7 | 25% Aqueous ammonia | 4.0 | 17.0 |
| Example 8 | 25% Aqueous ammonia | 5.0 | 17.0 |
| Example 9 | 25% Aqueous ammonia | 5.0 | 18.0 |
| Example 10 | 25% Aqueous ammonia | 4.0 | 17.0 |
| Example 11 | 25% Aqueous ammonia | 6.0 | 18.0 |
| Example 12 | 25% Aqueous ammonia | 6.0 | 18.0 |
| Example 13 | 25% Aqueous ammonia | 6.0 | 18.0 |
| Example 14 | 25% Aqueous ammonia | 6.0 | 18.0 |
| Comparative Example 4 | 25% Aqueous ammonia | 6.0 | 18.0 |
| Comparative Example 5 | 25% Aqueous ammonia | 6.0 | 18.0 |
| Comparative Example 6 | 25% Aqueous ammonia | 6.0 | 18.0 |
| Comparative Example 7 | 25% Aqueous ammonia | 6.0 | 18.0 |
| Example 15 | 25% Aqueous ammonia | 5.0 | 16.0 |
| Example 16 | 25% Aqueous ammonia | 5.0 | 16.0 |
| Example 17 | 25% Aqueous ammonia | 5.0 | 16.0 |
| Example 18 | 25% Aqueous ammonia | 5.0 | 16.0 |
| Comparative Example 8 | 25% Aqueous ammonia | 6.0 | 17.0 |
| Comparative Example 9 | 25% Aqueous ammonia | 6.0 | 17.0 |

| Examples and Comparative Examples | Production conditions of composite particles | | |
|---|---|---|---|
| | Acid catalyst | | Water |
| | Kind | Weight part(s) | Weight part(s) |
| Example 7 | 99% Acetic acid | 0.60 | 0.39 |
| Example 8 | 99% Acetic acid | 0.60 | 0.39 |
| Example 9 | 99% Acetic acid | 0.60 | 0.39 |
| Example 10 | 99% Acetic acid | 0.60 | 0.39 |
| Example 11 | 99% Acetic acid | 0.45 | 0.29 |
| Example 12 | 99% Acetic acid | 0.60 | 0.39 |
| Example 13 | 99% Acetic acid | 0.80 | 0.52 |
| Example 14 | 99% Acetic acid | 0.70 | 0.46 |
| Comparative Example 4 | 99% Acetic acid | 0.45 | 0.29 |
| Comparative Example 5 | 99% Acetic acid | 0.50 | 0.33 |
| Comparative Example 6 | 99% Acetic acid | 0.70 | 0.46 |
| Comparative Example 7 | 99% Acetic acid | 0.50 | 0.33 |
| Example 15 | 99% Acetic acid | 0.55 | 0.36 |
| Example 16 | 99% Acetic acid | 0.55 | 0.36 |
| Example 17 | 99% Acetic acid | 0.55 | 0.36 |
| Example 18 | 99% Acetic acid | 0.55 | 0.36 |
| Comparative Example 8 | 99% Acetic acid | 0.55 | 0.36 |
| Comparative Example 9 | 99% Acetic acid | 0.55 | 0.36 |

| Examples and Comparative Examples | Production conditions of composite particles | | |
|---|---|---|---|
| | Melamine | Aldehyde compound | |
| | Weight part(s) | Kind | Weight part(s) |
| Example 7 | 0.60 | 37% Formalin | 1.42 |
| Example 8 | 0.60 | 37% Formalin | 1.42 |
| Example 9 | 0.60 | 37% Formalin | 1.42 |
| Example 10 | 0.60 | 37% Formalin | 1.42 |
| Example 11 | 0.30 | 37% Formalin | 0.77 |
| Example 12 | 0.50 | 37% Formalin | 1.54 |

TABLE 4-continued

| | | | |
|---|---|---|---|
| Example 13 | 1.00 | 37% Formalin | 2.57 |
| Example 14 | 0.78 | 37% Formalin | 2.01 |
| Comparative Example 4 | 0.35 | 37% Formalin | 0.90 |
| Comparative Example 5 | 0.50 | 37% Formalin | 1.29 |
| Comparative Example 6 | 0.92 | 37% Formalin | 2.06 |
| Comparative Example 7 | 0.50 | 37% Formalin | 1.29 |
| Example 15 | 1.00 | 37% Formalin | 2.57 |
| Example 16 | 1.00 | 37% Formalin | 2.57 |
| Example 17 | 0.35 | 37% Formalin | 0.90 |
| Example 18 | 0.35 | 37% Formalin | 0.90 |
| Comparative Example 8 | 0.90 | 37% Formalin | 2.32 |
| Comparative Example 9 | 0.40 | 37% Formalin | 1.03 |

| Examples and Comparative Examples | Production conditions of composite particles | | |
|---|---|---|---|
| | Water Weight part (s) | Temperature ° C. | Time min |
| Example 7 | 1.61 | 85 | 120 |
| Example 8 | 1.61 | 85 | 120 |
| Example 9 | 1.61 | 85 | 120 |
| Example 10 | 1.61 | 85 | 120 |
| Example 11 | 0.88 | 80 | 120 |
| Example 12 | 1.76 | 80 | 120 |
| Example 13 | 2.93 | 80 | 120 |
| Example 14 | 2.29 | 80 | 120 |
| Comparative Example 4 | 1.03 | 85 | 120 |
| Comparative Example 5 | 1.47 | 85 | 120 |
| Comparative Example 6 | 2.35 | 85 | 120 |
| Comparative Example 7 | 1.47 | 85 | 120 |
| Example 15 | 2.93 | 85 | 120 |
| Example 16 | 2.93 | 85 | 120 |
| Example 17 | 1.03 | 85 | 120 |
| Example 18 | 1.03 | 85 | 120 |
| Comparative Example 8 | 2.64 | 85 | 120 |
| Comparative Example 9 | 1.17 | 85 | 120 |

| Examples and Comparative Examples | Heat treatment | | |
|---|---|---|---|
| | Degree of the reduced pressure (kPa) | Temperature (° C.) | Treating time (hr) |
| Example 7 | 65 | 230 | 4 |
| Example 8 | 65 | 200 | 3 |
| Example 9 | 65 | 170 | 2.5 |
| Example 10 | 50 | 200 | 3 |
| Example 11 | 55 | 190 | 3 |
| Example 12 | 55 | 190 | 3 |
| Example 13 | 55 | 190 | 3 |
| Example 14 | 55 | 190 | 3 |
| Comparative Example 4 | 50 | 230 | 3 |
| Comparative Example 5 | 80 | 240 | 3 |
| Comparative Example 6 | 38 | 245 | 3 |
| Comparative Example 7 | 60 | 170 | 3.5 |
| Example 15 | 80 | 180 | 2 |
| Example 16 | 60 | 150 | 2 |

TABLE 4-continued

| | | | |
|---|---|---|---|
| Example 17 | 55 | 250 | 3.5 |
| Example 18 | 40 | 230 | 3.5 |
| Comparative Example 8 | 80 | 170 | 2 |
| Comparative Example 9 | 65 | 245 | 3.5 |

TABLE 5

| Examples and Comparative Examples | Com-posite particles | Properties of composite particles | | |
|---|---|---|---|---|
| | | Average particle diameter (μm) | Shape factor | |
| | | | SF-1 | SF-2 |
| Example 7 | 1 | 40 | 102 | 104 |
| Example 8 | 2 | 31 | 103 | 104 |
| Example 9 | 3 | 36 | 104 | 105 |
| Example 10 | 4 | 42 | 103 | 105 |
| Example 11 | 5 | 48 | 102 | 103 |
| Example 12 | 6 | 48 | 105 | 103 |
| Example 13 | 7 | 49 | 103 | 104 |
| Example 14 | 8 | 48 | 104 | 103 |
| Comparative Example 4 | 9 | 42 | 106 | 105 |
| Comparative Example 5 | 10 | 43 | 105 | 103 |
| Comparative Example 6 | 11 | 43 | 105 | 104 |
| Comparative Example 7 | 12 | 43 | 103 | 104 |
| Example 15 | 13 | 33 | 104 | 103 |
| Example 16 | 14 | 34 | 104 | 103 |
| Example 17 | 15 | 34 | 104 | 104 |
| Example 18 | 16 | 35 | 103 | 105 |
| Comparative Example 8 | 17 | 28 | 105 | 104 |
| Comparative Example 9 | 18 | 29 | 103 | 104 |

| Examples and Comparative Examples | Properties of composite particles | | | |
|---|---|---|---|---|
| | Bulk density ($g/cm^3$) | Specific gravity ($g/cm^3$) | Saturation magnet-ization ($Am^2/kg$) | Residual magnet-ization ($Am^2/kg$) |
| Example 7 | 1.93 | 3.55 | 72.7 | 5.2 |
| Example 8 | 1.92 | 3.53 | 72.5 | 5.1 |
| Example 9 | 1.95 | 3.57 | 72.6 | 4.8 |
| Example 10 | 1.94 | 3.57 | 72.9 | 4.9 |
| Example 11 | 1.93 | 3.57 | 71.7 | 5.5 |
| Example 12 | 1.93 | 3.58 | 71.1 | 4.9 |
| Example 13 | 1.91 | 3.56 | 72.7 | 5.1 |
| Example 14 | 1.92 | 3.60 | 72.3 | 5.3 |
| Comparative Example 4 | 1.89 | 3.53 | 73.2 | 5.1 |
| Comparative Example 5 | 1.92 | 3.55 | 73.5 | 4.6 |
| Comparative Example 6 | 1.90 | 3.57 | 72.7 | 4.8 |
| Comparative Example 7 | 1.93 | 3.55 | 72.9 | 4.8 |
| Example 15 | 1.94 | 3.51 | 72.9 | 4.9 |
| Example 16 | 1.92 | 3.53 | 73.3 | 4.8 |
| Example 17 | 1.89 | 3.50 | 72.3 | 4.7 |
| Example 18 | 1.91 | 3.50 | 72.7 | 4.9 |
| Comparative Example 8 | 1.92 | 3.53 | 72.1 | 5.1 |

TABLE 5-continued

| | | | | |
|---|---|---|---|---|
| Comparative Example 9 | 1.93 | 3.52 | 71.2 | 5.3 |

| Examples and Comparative Examples | Properties of composite particles | | | |
|---|---|---|---|---|
| | Content of magnetic particles (%) | $\sigma_1 - \sigma_0$ | $\sigma_2 - \sigma_0$ | Electric resistance (Ω · cm) |
| Example 7 | 86 | −1.1 | −1.2 | 3.4E+10 |
| Example 8 | 86 | −0.9 | −1.0 | 2.2E+11 |
| Example 9 | 86 | −1.4 | −1.3 | 3.2E+12 |
| Example 10 | 86 | −1.4 | −1.4 | 8.2E+10 |
| Example 11 | 86 | −1.7 | −1.7 | 4.2E+09 |
| Example 12 | 86 | −1.8 | −1.8 | 2.7E+10 |
| Example 13 | 86 | −1.6 | −1.6 | 1.0E+13 |
| Example 14 | 87 | −1.8 | −1.8 | 4.2E+11 |
| Comparative Example 4 | 86 | −2.1 | −2.2 | 3.3E+09 |
| Comparative Example 5 | 86 | −2.2 | −2.2 | 8.2E+09 |
| Comparative Example 6 | 86 | −2.1 | −2.1 | 7.2E+11 |
| Comparative Example 7 | 86 | −2.2 | −2.1 | 9.0E+10 |
| Example 15 | 86 | −0.7 | −0.7 | 6.7E+13 |
| Example 16 | 86 | −0.8 | −0.8 | 5.2E+13 |
| Example 17 | 85 | −0.8 | −0.8 | 8.2E+08 |
| Example 18 | 85 | −0.7 | −0.7 | 2.5E+09 |
| Comparative Example 8 | 86 | −2.5 | −2.6 | 3.9E+13 |
| Comparative Example 9 | 86 | −2.6 | −2.5 | 1.8E+09 |

| Examples and Comparative Examples | Properties of composite particles | | |
|---|---|---|---|
| | Resin index $C_1$ (%) | $C_1/C_2$ | Water content (%) |
| Example 7 | 63 | 1.27 | 0.53 |
| Example 8 | 72 | 1.18 | 0.55 |
| Example 9 | 82 | 1.10 | 0.53 |
| Example 10 | 66 | 1.23 | 0.55 |
| Example 11 | 52 | 1.36 | 0.54 |
| Example 12 | 68 | 1.23 | 0.55 |
| Example 13 | 85 | 1.08 | 0.62 |
| Example 14 | 73 | 1.16 | 0.60 |
| Comparative Example 4 | 51 | 1.38 | 0.54 |
| Comparative Example 5 | 57 | 1.31 | 0.53 |
| Comparative Example 6 | 72 | 1.12 | 0.57 |
| Comparative Example 7 | 68 | 1.17 | 0.55 |
| Example 15 | 88 | 1.00 | 0.67 |
| Example 16 | 85 | 1.03 | 0.66 |
| Example 17 | 52 | 1.47 | 0.50 |
| Example 18 | 56 | 1.42 | 0.50 |
| Comparative Example 8 | 84 | 1.02 | 0.68 |
| Comparative Example 9 | 55 | 1.45 | 0.52 |

| Examples and Comparative Examples | Forced deterioration test | | |
|---|---|---|---|
| | Rate of change in electric charge amount | Rate of change in resistance | Surface condition |
| Example 7 | A | A | A |
| Example 8 | A | A | A |
| Example 9 | A | A | A |
| Example 10 | A | A | A |
| Example 11 | A | B | A |
| Example 12 | A | A | A |
| Example 13 | A | A | A |
| Example 14 | A | A | A |
| Comparative Example 4 | A | B | A |
| Comparative Example 5 | A | A | A |
| Comparative Example 6 | A | A | A |
| Comparative Example 7 | A | A | A |
| Example 15 | B | A | A |
| Example 16 | B | A | A |
| Example 17 | B | B | B |
| Example 18 | A | B | B |
| Comparative Example 8 | B | A | A |
| Comparative Example 9 | A | B | B |

Production of Resin-Coated Carrier

Example 19

Under a nitrogen flow, a Henschel mixer was charged with 1 kg of the spherical composite core particles 1, 10 g (as a solid content) of an acrylic resin ("BR80" (tradename) produced by Mitsubishi Rayon Co., Ltd.) and 1.5 g of carbon black ("TOKABLACK #4400" (tradename) produced by Tokai Carbon Co., Ltd.), and the contents of the Henschel mixer were stirred at a temperature of 50 to 150° C. for 1 hr, thereby forming a resin coating layer formed of the acrylic resin containing the carbon black on the surface of the respective particles.

The thus obtained resin-coated magnetic carrier 1 had an average particle diameter of 54 μm, a bulk density of 1.78 g/cm$^3$, a specific gravity of 3.52 g/cm$^3$, a saturation magnetization value of 73.8 Am$^2$/kg, and an electric resistance value of $9.5\times10^{11}$ Ω·m.

Example 20 and Comparative Example 10

The same procedure as in Example 19 was conducted under the same conditions except that the kind of spherical composite core particles was changed variously, thereby obtaining resin-coated magnetic carriers.

The production conditions of the resin-coated magnetic carriers obtained in Example 20 and Comparative Example 10 as well as various properties of the resin-coated magnetic carriers are shown in Table 6.

Example 21

Under a nitrogen flow, a Henschel mixer was charged with 1 kg of the spherical composite core particles 3, 10 g (as a solid content) of a silicone-based resin ("KR251" (tradename) produced by Shin-Etsu Chemical Co., Ltd.) and 1.5 g of carbon black ("TOKABLACK #4400" (tradename) produced by Tokai Carbon Co., Ltd.), and the contents of the Henschel mixer were stirred at a temperature of 50 to 150° C. for 1 hr, thereby forming a resin coating layer formed of the silicone-based resin containing the carbon black on the surface of the respective particles.

The production conditions of the resin-coated magnetic carrier 3 obtained in Example 21 as well as various properties of the resin-coated magnetic carrier are shown in Table 6.

Example 22 and Comparative Example 11

The same procedure as in Example 21 was conducted under the same conditions except that the kind of spherical composite core particles was changed variously, thereby obtaining resin-coated magnetic carriers.

The production conditions of the resin-coated magnetic carriers obtained in Example 22 and Comparative Example 11 as well as various properties of the resin-coated magnetic carriers are shown in Table 6.

Example 23

Under a nitrogen flow, a Henschel mixer was charged with 1 kg of the spherical composite core particles 5, 10 g (as a solid content) of a styrene-methyl methacrylate copolymer ("BR50" (tradename) produced by Mitsubishi Rayon Co., Ltd.) and 1.5 g of carbon black ("TOKABLACK #4400" (tradename) produced by Tokai Carbon Co., Ltd.), and the contents of the Henschel mixer were stirred at a temperature of 50 to 150° C. for 1 hr, thereby forming a resin coating layer formed of the styrene-methyl methacrylate copolymer containing the carbon black on the surface of the respective particles.

The production conditions of the resin-coated magnetic carrier 5 obtained in Example 23 as well as various properties of the resin-coated magnetic carrier are shown in Table 6.

Example 24 and Comparative Example 12

The same procedure as in Example 23 was conducted under the same conditions except that the kind of spherical composite core particles was changed variously, thereby obtaining resin-coated magnetic carriers.

The production conditions of the resin-coated magnetic carriers obtained in Example 24 and Comparative Example 12 as well as various properties of the resin-coated magnetic carriers are shown in Table 6.

The results of the forced deterioration test of the respective resin-coated magnetic carriers obtained in Examples 19 to 24 and Comparative Examples 10 to 12 are shown in Table 6. As a result, it was confirmed that when subjected to the forced deterioration test, the rates of change in electric charge amount and electric resistance value of any of the resin-coated magnetic carriers were small, and there occurred substantially no peeling-off of the coating layer on the surface of the particles.

Examples 25 to 28 and Comparative Examples 13 and 15

The same procedure as in Example 19 was conducted under the same conditions except that the kind of spherical composite particles was changed variously, thereby obtaining resin-coated magnetic carriers.

The production conditions of the resin-coated magnetic carriers obtained in Examples 25 to 28 and Comparative Examples 13 and 15 as well as various properties of the resin-coated magnetic carriers are shown in Table 7.

Examples 29 to 32 and Comparative Examples 14 and 16

The same procedure as in Example 21 was conducted under the same conditions except that the kind of spherical composite particles was changed variously, thereby obtaining resin-coated magnetic carriers.

The production conditions of the resin-coated magnetic carriers obtained in Examples 29 to 32 and Comparative Examples 14 and 16 as well as various properties of the resin-coated magnetic carriers are shown in Table 7.

Examples 33 to 36 and Comparative Examples 17 to 18

The same procedure as in Example 23 was conducted under the same conditions except that the kind of spherical composite particles was changed variously, thereby obtaining resin-coated magnetic carriers.

The production conditions of the resin-coated magnetic carriers obtained in Examples 33 to 36 and Comparative Examples 17 to 18 as well as various properties of the resin-coated magnetic carriers are shown in Table 7.

TABLE 6

| | | | Composition of magnetic carrier | | | |
|---|---|---|---|---|---|---|
| | | | Coating resin | | Additive | |
| Examples and Comparative Examples | Composite core particles | Resin-coated carrier | Kind | Ratio to core material (%) | Kind | Ratio to resin (%) |
| Example 19 | Example 1 | 1 | *1 | 1.0 | *4 | 15 |
| Example 20 | Example 2 | 2 | *1 | 1.0 | *4 | 15 |
| Example 21 | Example 3 | 3 | *2 | 1.0 | *4 | 15 |
| Example 22 | Example 4 | 4 | *2 | 1.0 | *4 | 15 |
| Example 23 | Example 5 | 5 | *3 | 1.0 | *4 | 15 |
| Example 24 | Example 6 | 6 | *3 | 1.0 | *4 | 15 |
| Comparative Example 10 | Comparative Example 1 | 7 | *1 | 1.0 | *4 | 15 |
| Comparative Example 11 | Comparative Example 2 | 8 | *2 | 1.0 | *4 | 15 |
| Comparative Example 12 | Comparative Example 3 | 9 | *3 | 1.0 | *4 | 15 |

| | Properties of magnetic carrier | | | |
|---|---|---|---|---|
| Examples and Comparative Examples | Average particle diameter (μm) | Shape factor SF-1 | Shape factor SF-2 | Bulk density (g/cm$^3$) |
| Example 19 | 54 | 103 | 105 | 1.78 |
| Example 20 | 36 | 104 | 103 | 1.80 |
| Example 21 | 41 | 106 | 105 | 1.81 |
| Example 22 | 33 | 104 | 106 | 1.82 |
| Example 23 | 45 | 105 | 105 | 1.84 |
| Example 24 | 38 | 103 | 105 | 1.80 |

TABLE 6-continued

| | | | | |
|---|---|---|---|---|
| Comparative Example 10 | 39 | 102 | 104 | 1.88 |
| Comparative Example 11 | 28 | 104 | 103 | 1.85 |
| Comparative Example 12 | 38 | 104 | 103 | 1.86 |

| Examples and Comparative Examples | Properties of magnetic carrier | | | |
|---|---|---|---|---|
| | Specific gravity ($g/cm^3$) | Saturation magnetization ($Am^2/kg$) | Electric resistance ($\Omega \cdot cm$) | Water content (%) |
| Example 19 | 3.52 | 73.8 | 9.5E+11 | 0.53 |
| Example 20 | 3.60 | 72.5 | 7.9E+10 | 0.57 |
| Example 21 | 3.52 | 72.5 | 4.8E+11 | 0.58 |
| Example 22 | 3.55 | 72.8 | 2.8E+13 | 0.55 |
| Example 23 | 3.55 | 73.0 | 1.0E+13 | 0.57 |
| Example 24 | 3.55 | 71.2 | 2.2E+11 | 0.55 |
| Comparative Example 10 | 3.57 | 74.1 | 8.0E+10 | 0.55 |
| Comparative Example 11 | 3.52 | 73.8 | 1.1E+13 | 0.60 |
| Comparative Example 12 | 3.57 | 73.0 | 2.5E+12 | 0.57 |

| Examples and Comparative Examples | Forced deterioration test | | | |
|---|---|---|---|---|
| | Rate of change in electric charge amount | Rate of change in resistance | Coating condition | Machine evaluation Carrier adhesion |
| Example 19 | A | A | A | A |
| Example 20 | A | A | A | A |
| Example 21 | A | A | A | B |
| Example 22 | B | B | B | B |
| Example 23 | A | A | A | B |
| Example 24 | A | B | A | A |
| Comparative Example 10 | A | A | A | D |
| Comparative Example 11 | A | A | A | D |
| Comparative Example 12 | A | A | A | D |

Note
*1: Acrylic resin;
*2: Silicone-based resin;
*3: Styrene-acrylic resin;
*4: Carbon black

TABLE 7

| Examples and Comparative Examples | Composite particles | Resin-coated carrier | Composition of magnetic carrier | | | |
|---|---|---|---|---|---|---|
| | | | Coating resin | | Additive | |
| | | | Kind | Ratio to core material (%) | Kind | Ratio to resin (%) |
| Example 25 | Example 7 | 10 | *1 | 1.0 | *4 | 15 |
| Example 26 | Example 8 | 11 | *1 | 1.0 | *4 | 15 |
| Example 27 | Example 9 | 12 | *1 | 1.0 | *4 | 15 |
| Example 28 | Example 10 | 13 | *1 | 1.0 | *4 | 15 |
| Example 29 | Example 11 | 14 | *2 | 1.0 | *4 | 15 |
| Example 30 | Example 12 | 15 | *2 | 1.0 | *4 | 15 |
| Example 31 | Example 13 | 16 | *2 | 1.0 | *4 | 15 |
| Example 32 | Example 14 | 17 | *2 | 1.0 | *4 | 15 |
| Comparative Example 13 | Comparative Example 4 | 18 | *1 | 1.0 | *4 | 15 |
| Comparative Example 14 | Comparative Example 5 | 19 | *2 | 1.0 | *4 | 15 |
| Comparative Example 15 | Comparative Example 6 | 20 | *1 | 1.0 | *4 | 15 |

TABLE 7-continued

| | | | | | | |
|---|---|---|---|---|---|---|
| Comparative Example 16 | Comparative Example 7 | 21 | *2 | 1.0 | *4 | 15 |
| Example 33 | Example 15 | 22 | *3 | 1.0 | *4 | 15 |
| Example 34 | Example 16 | 23 | *3 | 1.0 | *4 | 15 |
| Example 35 | Example 17 | 24 | *3 | 1.0 | *4 | 15 |
| Example 36 | Example 18 | 25 | *3 | 1.0 | *4 | 15 |
| Comparative Example 17 | Comparative Example 8 | 26 | *3 | 1.0 | *4 | 15 |
| Comparative Example 18 | Comparative Example 9 | 27 | *3 | 1.0 | *4 | 15 |

| Examples and Comparative Examples | Properties of magnetic carrier | | | |
|---|---|---|---|---|
| | Average particle diameter (μm) | Shape factor | | Bulk density ($g/cm^3$) |
| | | SF-1 | SF-2 | |
| Example 25 | 41 | 103 | 105 | 1.90 |
| Example 26 | 32 | 104 | 105 | 1.89 |
| Example 27 | 35 | 103 | 104 | 1.92 |
| Example 28 | 42 | 104 | 105 | 1.89 |
| Example 29 | 49 | 103 | 104 | 1.91 |
| Example 30 | 48 | 104 | 105 | 1.87 |
| Example 31 | 50 | 102 | 103 | 1.88 |
| Example 32 | 49 | 103 | 104 | 1.89 |
| Comparative Example 13 | 42 | 105 | 106 | 1.85 |
| Comparative Example 14 | 43 | 104 | 103 | 1.87 |
| Comparative Example 15 | 44 | 104 | 105 | 1.87 |
| Comparative Example 16 | 44 | 104 | 103 | 1.91 |
| Example 33 | 33 | 103 | 104 | 1.92 |
| Example 34 | 35 | 103 | 105 | 1.89 |
| Example 35 | 35 | 104 | 105 | 1.87 |
| Example 36 | 34 | 104 | 104 | 1.90 |
| Comparative Example 17 | 29 | 104 | 105 | 1.89 |
| Comparative Example 18 | 30 | 103 | 105 | 1.88 |

| Examples and Comparative Examples | Properties of magnetic carrier | | | |
|---|---|---|---|---|
| | Specific gravity ($g/cm^3$) | Saturation magnetization ($Am^2/kg$) | Electric resistance ($\Omega \cdot cm$) | Water content (%) |
| Example 25 | 3.51 | 73.1 | 2.2E+12 | 0.55 |
| Example 26 | 3.51 | 72.0 | 1.2E+13 | 0.56 |
| Example 27 | 3.54 | 72.2 | 9.7E+13 | 0.51 |
| Example 28 | 3.56 | 72.5 | 2.8E+12 | 0.56 |
| Example 29 | 3.55 | 72.0 | 2.2E+11 | 0.55 |
| Example 30 | 3.53 | 71.2 | 2.7E+12 | 0.57 |
| Example 31 | 3.57 | 72.5 | 1.5E+14 | 0.60 |
| Example 32 | 3.58 | 72.0 | 1.0E+13 | 0.58 |
| Comparative Example 13 | 3.50 | 72.9 | 1.3E+11 | 0.55 |
| Comparative Example 14 | 3.54 | 73.0 | 4.2E+11 | 0.56 |
| Comparative Example 15 | 3.55 | 72.5 | 1.8E+13 | 0.58 |
| Comparative Example 16 | 3.56 | 72.5 | 6.2E+12 | 0.56 |
| Example 33 | 3.49 | 72.7 | 3.3E+15 | 0.65 |
| Example 34 | 3.51 | 73.0 | 1.3E+15 | 0.64 |
| Example 35 | 3.48 | 72.0 | 4.4E+10 | 0.53 |
| Example 36 | 3.49 | 72.3 | 1.3E+11 | 0.51 |
| Comparative Example 17 | 3.51 | 71.9 | 6.7E+14 | 0.67 |
| Comparative Example 18 | 3.50 | 71.0 | 8.7E+10 | 0.50 |

Note
*1: Acrylic resin;
*2: Silicone-based resin;
*3: Styrene-acrylic resin;
*4: Carbon black From the results of the above machine evaluation, it was confirmed that the magnetic carrier and developer according to the present invention can exhibit a good durability, is free from occurrence of carrier adhesion, and can maintain a high quality of images produced for a long period of time.

INDUSTRIAL APPLICABILITY

The magnetic carrier according to the Invention 1 reduce dispersion in magnetization value, and therefore can be suitably used as a magnetic carrier for an electrophotographic developer.

The magnetic carrier according to the Invention 2 reduce dispersion in magnetization value thereof and can exhibit an electric charge amount, an electric resistance value and an outermost surface strength as desired by controlling a coating ratio of a melamine resin coating layer formed on a surface of the respective carrier particles, and therefore can be suitably used as a magnetic carrier for an electrophotographic developer.

The magnetic carrier according to the Invention 3 reduce dispersion in magnetization value thereof and can exhibit an electric charge amount, an electric resistance value and an outermost surface strength as desired by controlling a coating ratio of a melamine resin coating layer formed on a surface of the respective carrier particles, and therefore can be suitably used as a magnetic carrier for an electrophotographic developer.

The magnetic carrier according to the Invention 4 reduce dispersion in magnetization value thereof and can exhibit an electric charge amount, an electric resistance value and an outermost surface strength as desired by controlling a coating ratio of a melamine resin coating layer formed on a surface of the respective carrier particles, and therefore can be suitably used as a magnetic carrier for an electrophotographic developer.

The resin-coated magnetic carrier according to the Invention 5 is free from occurrence of carrier adhesion, can be prevented from suffering from occurrence of spent toner and can exhibit an further enhanced durability, and therefore can be suitably used as a magnetic carrier for an electrophotographic developer.

The two-component system developer according to the Invention 6 can exhibit a good durability, is free from occurrence of carrier adhesion, and can maintain a high quality of images produced for a long period of time, in particular, in a high-voltage range where an electric resistance of a core material tends to be considerably influenced, it is possible to suppress the occurrence of brush marks on a solid image portion owing to leakage phenomenon of electric charges and images defects such as being inferior to gradation characteristics. Further, it is possible to prevent the magnetic carrier from deterioration with time owing to abrasion or peeling-off of the coating resin therefrom when used for a long period of time, and therefore can be suitably used as a developer comprising the magnetic carrier for an electrophotographic developer, and a toner.

The process for producing a magnetic carrier according to the Invention 7 can provide a magnetic carrier that reduce dispersion in magnetization value by reacting ferromagnetic iron oxide fine particles having a compressed density of 2.3 to 3.0 g/cm$^3$, a phenol compound and an aldehyde compound in an aqueous medium in the presence of a basic catalyst to produce spherical composite core particles comprising the ferromagnetic iron oxide fine particles and a cured phenol resin, and therefore can be suitably used as a process for producing a magnetic carrier for an electrophotographic developer.

The process for producing a magnetic carrier according to the Invention 8 can provide a magnetic carrier that reduce dispersion in magnetization value by adding an acid aqueous solution comprising an acid having an acid dissociation constant pKa of 3 to 6 as an acid catalyst and a methylol melamine aqueous solution to an aqueous medium containing spherical composite core particles comprising ferromagnetic iron oxide fine particles having a compressed density of 2.4 to 3.5 g/cm and a cured phenol resin and can exhibit an electric charge amount, an electric resistance value and an outermost surface strength as desired by controlling a coating ratio of a melamine resin coating layer formed on a surface of the respective carrier particles, and therefore can be suitably used as a process for producing a magnetic carrier for an electrophotographic developer.

The invention claimed is:

1. A magnetic carrier for an electrophotographic developer comprising spherical composite core particles comprising at least ferromagnetic iron oxide fine particles having a compressed density of 2.3 to 3.0 g/cm$^3$ and a cured phenol resin, and having a volume based average particle diameter of 20 to 60 μm, the magnetic carrier for an electrophotographic developer satisfying the following formula (1):

$$\sigma_1-\sigma_0=-2 \text{ to } 0 \quad (1)$$

wherein $\sigma_0$ represents a saturation magnetization (Am$^2$/kg) of the carrier particles obtained by following method (1) and $\sigma_1$ represents a saturation magnetization (Am$^2$/kg) of the carrier particles obtained by following method (2), wherein non magnetic particles are not present in the magnetic carrier in combination with the ferromagnetic iron oxide fine particles, and wherein, in method (1):

where the carrier particles for the measurement of $\sigma_0$ have an average particle diameter of 20 to less than 30 μm, the carrier particles for the measurement of $\sigma_0$ are classified by test sieves having mesh sizes of 20 μm and 38 μm;

where the carrier particles for the measurement of $\sigma_0$ have an average particle diameter of 30 to less than 40 μm, the carrier particles for the measurement of $\sigma_0$ are classified by test sieves having mesh sizes of 25 μm and 45 μm;

where the carrier particles for the measurement of $\sigma_0$ have an average particle diameter of 40 to less than 50 μm, the carrier particles for the measurement of $\sigma_0$ are classified by test sieves having mesh sizes of 32 μm and 53 μm; and where the carrier particles for the measurement of $\sigma_0$ have an average particle diameter of 50 to 60 μm, the carrier particles for the measurement of $\sigma_0$ are classified by test sieves having mesh sizes of 45 μm and 63 μm; and wherein, in the method (2): the carrier particles for the measurement of $\sigma_1$ have an average particle diameter of less than 20 μm and are classified by test sieves having mesh sizes of 20 μm.

2. The magnetic carrier for an electrophotographic developer according to claim 1, further comprising a resin coating layer produced from at least one resin selected from the group consisting of a silicone-based resin, an acrylic resin and a styrene-acrylic resin, the resin coating layer being formed on a surface of the respective spherical composite core particles or on a surface of the respective spherical composite particles.

3. A process for producing the magnetic carrier for an electrophotographic developer as claimed in claim 1, comprising the step of reacting at least ferromagnetic iron oxide fine particles having a compressed density CD of 2.3 to 3.0 g/cm$^3$, a phenol compound and an aldehyde compound in an aqueous medium in the presence of a basic catalyst to produce spherical composite core particles comprising the ferromagnetic iron oxide fine particles and a cured phenol resin.

4. A magnetic carrier for an electrophotographic developer comprising spherical composite particles comprising spherical composite core particles having a volume based average particle diameter of 20 to 60 μm, comprising at least ferromagnetic iron oxide fine particles having a compressed density of 2.3 to 3.0 g/cm$^3$ and a cured phenol resin and a melamine resin coating layer formed on a surface of the respective core particles, (i) the magnetic carrier for an electrophotographic developer having a resin index $C_1$ of 50 to 90%; and (ii) the magnetic carrier for an electrophotographic developer satisfying the following formula (1):

$$\sigma_1-\sigma_0=-2 \text{ to } 0 \quad (1)$$

wherein $\sigma_0$ represents a saturation magnetization (Am$^2$/kg) of the carrier particles obtained by following method (1) and $\sigma_1$ represents a saturation magnetization (Am$^2$/kg) of the carrier particles obtained by following method (2), wherein non magnetic particles are not present in the magnetic carrier in combination with the ferromagnetic iron oxide fine particles, wherein resin index $C_1$ is a proportion of a resin in the composite core particles or the composite particles that is defined by a ratio of an area of a resin portion to a whole area in a backscattered electron image of the respective particles when observing the particles using a scanning electron microscope at an acceleration voltage of 1 kV, and wherein, in method (1):

where the carrier particles for the measurement of $\sigma_0$ have an average particle diameter of 20 to less than 30 μm, the carrier particles for the measurement of $\sigma_0$ are classified by test sieves having mesh sizes of 20 μm and 38 μm;

where the carrier particles for the measurement of $\sigma_0$ have an average particle diameter of 30 to less than 40 μm, the carrier particles for the measurement of $\sigma_0$ are classified by test sieves having mesh sizes of 25 μm and 45 μm;

where the carrier particles for the measurement of $\sigma_0$ have an average particle diameter of 40 to less than 50 μm, the carrier particles for the measurement of $\sigma_0$ are classified by test sieves having mesh sizes of 32 μm and 53 μm; and where the carrier particles for the measurement of $\sigma_0$ have an average particle diameter of 50 to 60 μm, the carrier particles for the measurement of $\sigma_0$ are classified by test sieves having mesh sizes of 45 μm and 63 μm; and wherein, in the method (2): the carrier particles for the measurement of $\sigma_1$ have an average particle diameter of less than 20 μm and are classified by test sieves having mesh sizes of 20 μm.

5. The magnetic carrier for an electrophotographic developer according to claim 4, wherein resin indices $C_1$ and $C_2$ of the magnetic carrier satisfy the following formula (2):

$$C_1/C_2=1.05 \text{ to } 1.40 \quad (2),$$

wherein resin index $C_2$ is a proportion of a resin in the composite core particles or the composite particles that is defined by a ratio of an area of a resin portion to a whole area in a backscattered electron image of the respective particles when observing the particles using a scanning electron microscope at an acceleration voltage of 2 kV.

6. The magnetic carrier for an electrophotographic developer according to claim 4, wherein an electric resistance value of the magnetic carrier is $1.0\times10^6$ to $1.0\times10^{16}$ Ωcm as measured by applying a voltage of 100 V thereto.

7. A two-component system developer comprising the magnetic carrier for an electrophotographic developer as claimed in claim 4 and a toner.

8. A process for producing the magnetic carrier for an electrophotographic developer as claimed in claim 4, comprising the steps of:

reacting at least ferromagnetic iron oxide fine particles having a compressed density CD of 2.3 to 3.0 g/cm$^3$, a phenol compound and an aldehyde compound in an aqueous medium in the presence of a basic catalyst to produce spherical composite core particles comprising the ferromagnetic iron oxide fine particles and a cured phenol resin;

then adding an acid aqueous solution comprising an acid having an acid dissociation constant pKa of 3 to 6 as an acid catalyst and a methylol melamine aqueous solution to the aqueous medium comprising the resulting spherical composite core particles to form a coating layer comprising a melamine resin on a surface of the respective spherical composite core particles; and further subjecting the resulting particles to heat treatment in an inert atmosphere at a temperature of 150 to 250° C. under a degree of the reduced pressure of 40 to 80 kPa.

* * * * *